US010603232B2

(12) United States Patent
Levine

(10) Patent No.: US 10,603,232 B2
(45) Date of Patent: Mar. 31, 2020

(54) WHEELCHAIR LIFTING DEVICE

(71) Applicant: Marc Levine, Santa Clarita, CA (US)

(72) Inventor: Marc Levine, Santa Clarita, CA (US)

( * ) Notice: Subject to any disclaimer, the term of this patent is extended or adjusted under 35 U.S.C. 154(b) by 55 days.

(21) Appl. No.: 15/635,193

(22) Filed: Jun. 27, 2017

(65) Prior Publication Data

US 2018/0014989 A1 Jan. 18, 2018

Related U.S. Application Data

(63) Continuation-in-part of application No. 14/999,780, filed on Jun. 27, 2016.

(51) Int. Cl.
*A61G 5/10* (2006.01)

(52) U.S. Cl.
CPC ..... *A61G 5/104* (2013.01)

(58) Field of Classification Search
CPC ..... A61G 5/10; A61G 5/104; A61G 5/068; A61G 3/02; A61G 3/0209
See application file for complete search history.

(56) References Cited

U.S. PATENT DOCUMENTS 3,476,404 A * 11/1969 Rachman ..... A61G 3/063 280/30
3,888,463 A * 6/1975 O'Brien ..... A61G 3/063 187/900
4,084,830 A * 4/1978 Daniel, Jr. ..... B60S 9/06 254/420
4,725,183 A * 2/1988 Smillie, III ..... B60R 5/04 187/244
4,759,684 A * 7/1988 Lanzillotta ..... A61G 5/104 187/200
4,916,933 A * 4/1990 Celette ..... B21D 1/14 187/216
4,941,799 A * 7/1990 Gordon ..... A61G 5/104 254/124
4,984,657 A * 1/1991 Burns ..... B66F 7/025 187/207
5,105,915 A * 4/1992 Gary ..... A61G 3/063 14/71.3
5,211,264 A * 5/1993 Beattie ..... B66F 7/04 187/208
5,230,522 A * 7/1993 Gehlsen ..... A61G 3/063 180/8.2
5,421,692 A * 6/1995 Varrichio ..... A61G 5/104 187/200
6,269,676 B1 * 8/2001 Soyk ..... B66F 7/0641 72/457

(Continued)

*Primary Examiner* — Peter M. Cuomo
*Assistant Examiner* — Ifeolu A Adeboyejo

(57) ABSTRACT

A wheelchair lifting device is disclosed. The wheelchair lifting device has a stationary platform, a movable lift assembly, a number of motorized lifting jacks, a foot stand platform, a battery power supply and a wireless lift controller and receiver. The movable lift assembly is attached to the stationary platform by the lifting jacks, and the movable lift assembly can be lifted and lowered relative to the stationary platform by the lifting jacks. The base of the movable lift assembly may be level with or nearly level with the stationary platform when in a lowered position to enable a wheelchair to roll onto the lift assembly without requiring a ramp. In some embodiments, the wheelchair lift includes a scale to weigh the occupant.

13 Claims, 23 Drawing Sheets

(56) References Cited

U.S. PATENT DOCUMENTS

| | | | | |
|---|---|---|---|---|
| 6,547,509 | B1 * | 4/2003 | Edmo | B66F 7/0641 187/269 |
| 6,695,289 | B1 * | 2/2004 | Mickael | B66F 3/12 187/211 |
| 7,896,134 | B2 * | 3/2011 | Morris | A61G 3/063 187/200 |
| 8,239,988 | B2 * | 8/2012 | Brenner | A47C 16/025 5/648 |
| 2003/0213653 | A1 * | 11/2003 | Morris | B66B 9/0853 187/269 |
| 2004/0161321 | A1 * | 8/2004 | Blake | B62B 1/002 414/444 |
| 2006/0120837 | A1 * | 6/2006 | Hung | A61G 3/063 414/347 |
| 2008/0042114 | A1 * | 2/2008 | Stanislao | B66B 9/083 254/89 R |
| 2008/0250984 | A1 * | 10/2008 | Panzarella | A61G 3/0209 108/44 |
| 2009/0278098 | A1 * | 11/2009 | Bacon | B66F 7/0625 254/1 |
| 2013/0111660 | A1 * | 5/2013 | Wilson | A61G 7/10 5/86.1 |
| 2015/0231002 | A1 * | 8/2015 | Gierse | A61G 5/1059 297/344.16 |

* cited by examiner

WHEELCHAIR LIFTING DEVICE

INCORPORATION BY REFERENCE TO RELATED APPLICATIONS

This application claims the benefit of priority under 35 U.S.C. § 120 from and is a continuation-in-part of U.S. Utility application Ser. No. 14/999,780, filed on Jun. 27, 2016, which is hereby expressly incorporated by reference in its entirety and is to be considered as a part of this specification.

BACKGROUND OF THE INVENTION

Field of the Invention

This patent document relates to wheelchair accessories and method of use thereof, and more particularly relates to a new and improved wheelchair lifting device.

Description of the Related Art

Wheelchairs are often used to transport disabled or injured people who do not have full use of their legs or are a fall or injury risk due to instability, injury, or fragility. Wheelchairs are an excellent tool to move people smoothly from one point to another; however, occasionally individuals need to be lifted from their wheelchairs to enter beds, chairs, vehicles, or medical test equipment. In many cases, caregivers (e.g., family, healthcare staff, or helpers) must physically transfer a patient from a low wheelchair height to a higher bed or gurney height.

During transfer, caregivers often exert themselves, and these transfers expose both the caregiver and the wheelchair occupant to injury risk or awkward uncomfortable embraces. Lift injuries are among the most common injuries in medical and care facilities.

Various wheelchair lifts have been developed, including stationary lifts developed to address specific obstacles—such as a staircase or elevated platform—and vehicle-mounted lifts for assisting people entering and exiting specific vehicles. However, these solutions require heavy, stationary equipment, and installing stationary lifts near even a fraction of beds or medical test devices would be impractical in both cost and space. A lightweight, stable, portable wheelchair lift could increase patient comfort and staff convenience while reducing injuries to staff and patients.

Staff and patients in medical facilities, or even in their homes, would appreciate an easily transported wheelchair lift enabling a wheelchair to easily roll onto the lift and raised or lowered to a desired height to comfortably transfer a person from the wheelchair to another support.

SUMMARY OF THE INVENTION

There exists a continuing need for a lightweight, stable, portable lift for raising and lowering wheelchair occupants to facilitate the transfer of occupants to and from beds, chairs, vehicles, or medical test equipment. The wheelchair lift may also be foldable and storable and controlled by one or more control panels comfortably accessed by either the wheelchair occupant or caregiver. Some of the various aspects disclosed herein are summarized below.

In one aspect, a portable wheelchair lift comprises a movable lift assembly, a number of motorized lifting jacks, a stationary platform (stationary relative to the movable lift assembly while raising or lowering), a foot stand platform, a power supply and a lift controller and receiver. The movable lift assembly may be composed of a single panel, front and rear support plates, or multiple foldable panels or elements to minimize storage footprint. The movable lift assembly is attached to the stationary platform by the lifting jacks, and the movable lift assembly can be lifted and lowered relative to the stationary platform by the lifting jacks.

In its lowered position, the base of the movable lift assembly may be level with or nearly level with the stationary platform when in a lowered position, and the wheel wells may be positioned and configured to enable a wheelchair to easily roll onto the lift assembly without needing an external ramp. This may be accomplished by either using thinner materials at the wheel well or by building an angled entry to the wheel well, allowing a wheelchair to easily transition from the ground to the movable lift assembly. The wheelchair lift is configured to secure the wheelchair in position so that the wheelchair will not roll or tip off of the movable lift assembly when the lift assembly is in an elevated position. The wheelchair lift is configured to lift the wheelchair vertically without any lifting elements extending beyond the lateral dimensions of the stationary platform, minimizing the risk of tangling with any loose cloth, wires, tubes, or other equipment. The wheelchair lift may include an exterior sidewall surrounding the movable lift assembly, separating and protecting the moving elements and the users. The movable lift assembly is connected to—and elevated relative to—the stationary platform by the lift jacks (or lift assembly).

The lift assembly may include scissor jacks, alligator jacks, actuator, or piston attaching the movable lift assembly to the stationary platform. The lift assembly is capable of lifting the movable lift assembly relative to the stationary platform, and in some embodiments is capable of lifting a wheelchair to 14 inches. The capability to raise and lower to a plurality of heights, to allow manual height change, or to set and automatically raise or lower to or between pre-set heights constitute additional aspects of the disclosed lift.

The wheelchair lift is preferably portable, lightweight, and foldable for easy transportation and storage by a single user. The various electronic components and circuitry and their relative position within the housing and to one another constitute yet additional aspects of the disclosed wheelchair lift. In some aspects, elements that do not need to be elevated along with the movable lift assembly may be fixed to the stationary platform, minimizing the weight of the movable lift assembly, thereby reducing the energy needed to lift. In some aspects, these non-lifted components may be positioned on the stationary platform to optimize stability when the movable lift assembly is elevated, to minimize construction cost, or to fit in regions of the lift that will not interfere with the lift jacks or where the wheelchair lift is thick enough to accommodate the components.

In some aspects, the wheelchair lift may be operated by on-lift controls. These on-lift controls may include but are not limited to traditional buttons, foot pedals, switches, joysticks, touchscreens, voice control, remote control, or automated control. In other aspects, the wheelchair lift may be operated by a displaced controller either instead of or in addition to the on-lift controls. In some aspects, the displaced controller may be either wireless or connected by wire to the wheelchair lift. In some aspects the controller may be hand-held by the wheelchair occupant or by a person transporting or providing assistance to the wheelchair occupant. In other aspects the controller may be mountable on the wheelchair or on a body-mounted control. In some aspects, the wheelchair lift may be paired with and operated by a smartphone, wearable computer, or smart home base station (possibly through either an app or recipe).

The method of manufacture and method of use of the wheelchair lift constitute yet additional aspects of the disclosure.

The ornamental aspects of the external shape of the wheelchair lift provide yet additional aspects of the disclosure and may be independently pursued through design patent protection.

Other objects and advantages of the present invention will become apparent from the following description, drawings, and claims. Each of the foregoing various aspects summarized above and/or additional aspects disclosed herein may be combined in any way without limitation.

BRIEF DESCRIPTION OF THE DRAWINGS

These aspects, particular features, and advantages are described below with reference to the drawings, which are intended to illustrate but not to limit the scope of the inventive subject matter disclosed herein. For ease of reference, in the drawings, like reference characters denote corresponding features in other drawings.

DETAILED DESCRIPTION OF THE PREFERRED EMBODIMENT

Disclosed herein are detailed descriptions of an embodiments of a portable wheelchair lift configured to raise and lower a wheelchair and its occupant between a ground level and an elevated height for easy transfer of the occupant to either a standing position or to another support surface (e.g., a bed, a chair, a vehicle, medical test equipment, or any other area). The wheelchair lift may also be used by a wheelchair occupant who needs a higher position to cook, shave, teach, or apply make-up.

Figure 16:
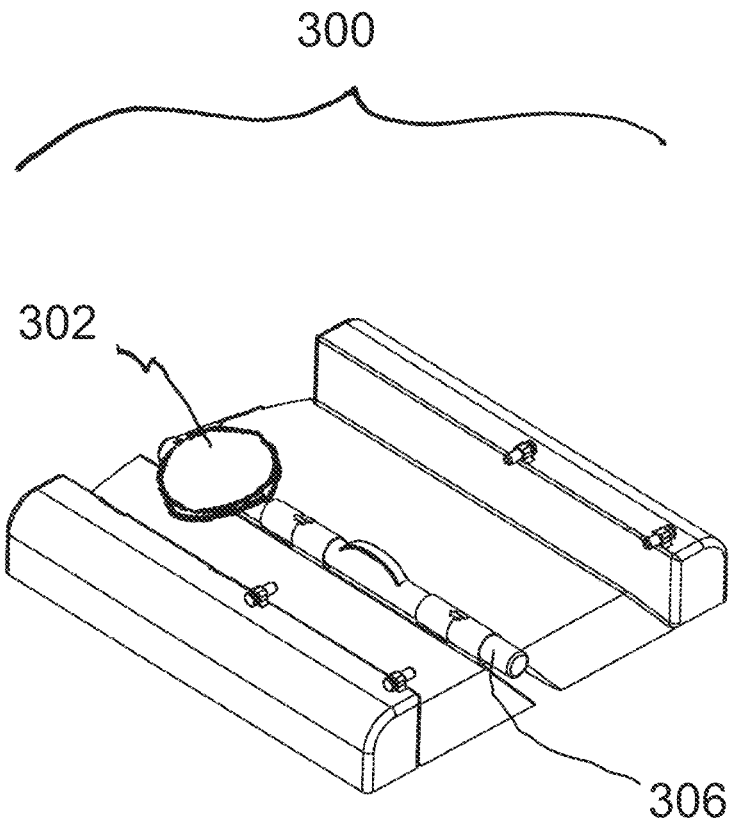
FIG. 16 is a perspective view of a third embodiment of the wheelchair lift in the use position.
Figure 17:
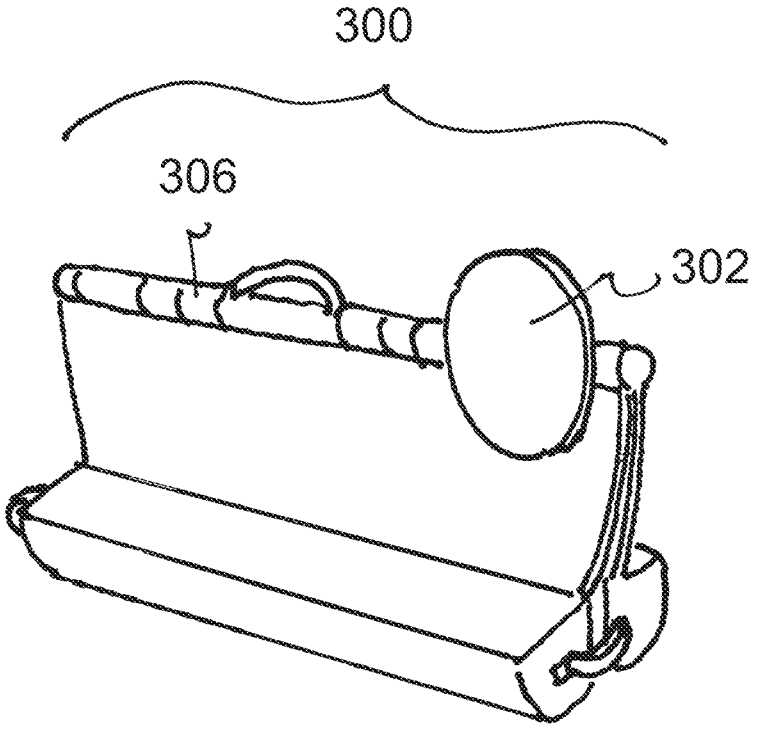
FIG. 17 is a perspective view of a third embodiment of the wheelchair lift in the folded position.
Figure 18:
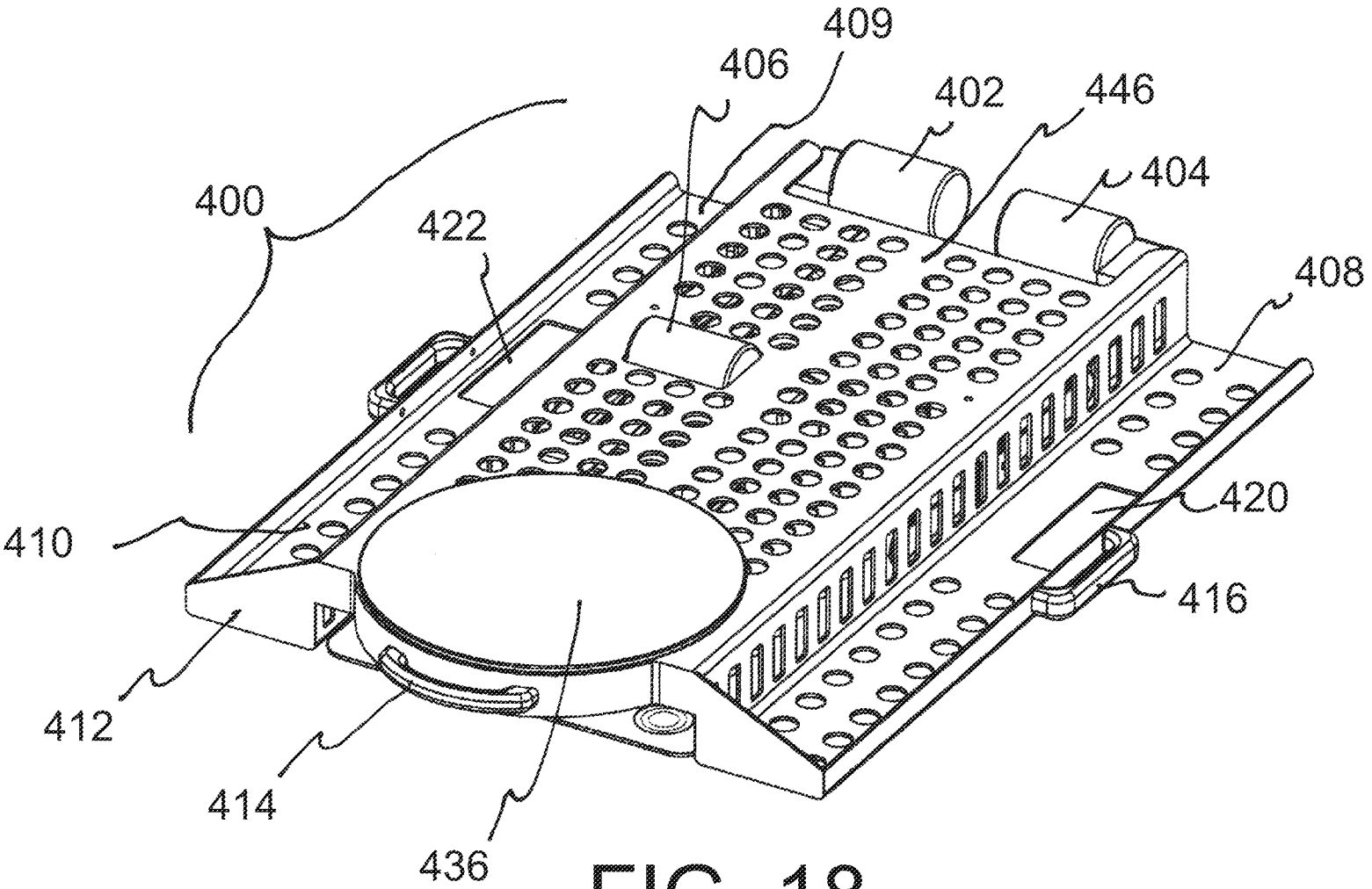
FIG. 18 is a perspective view of a fourth embodiment of the wheelchair lift in the lowered position.
Figure 22:
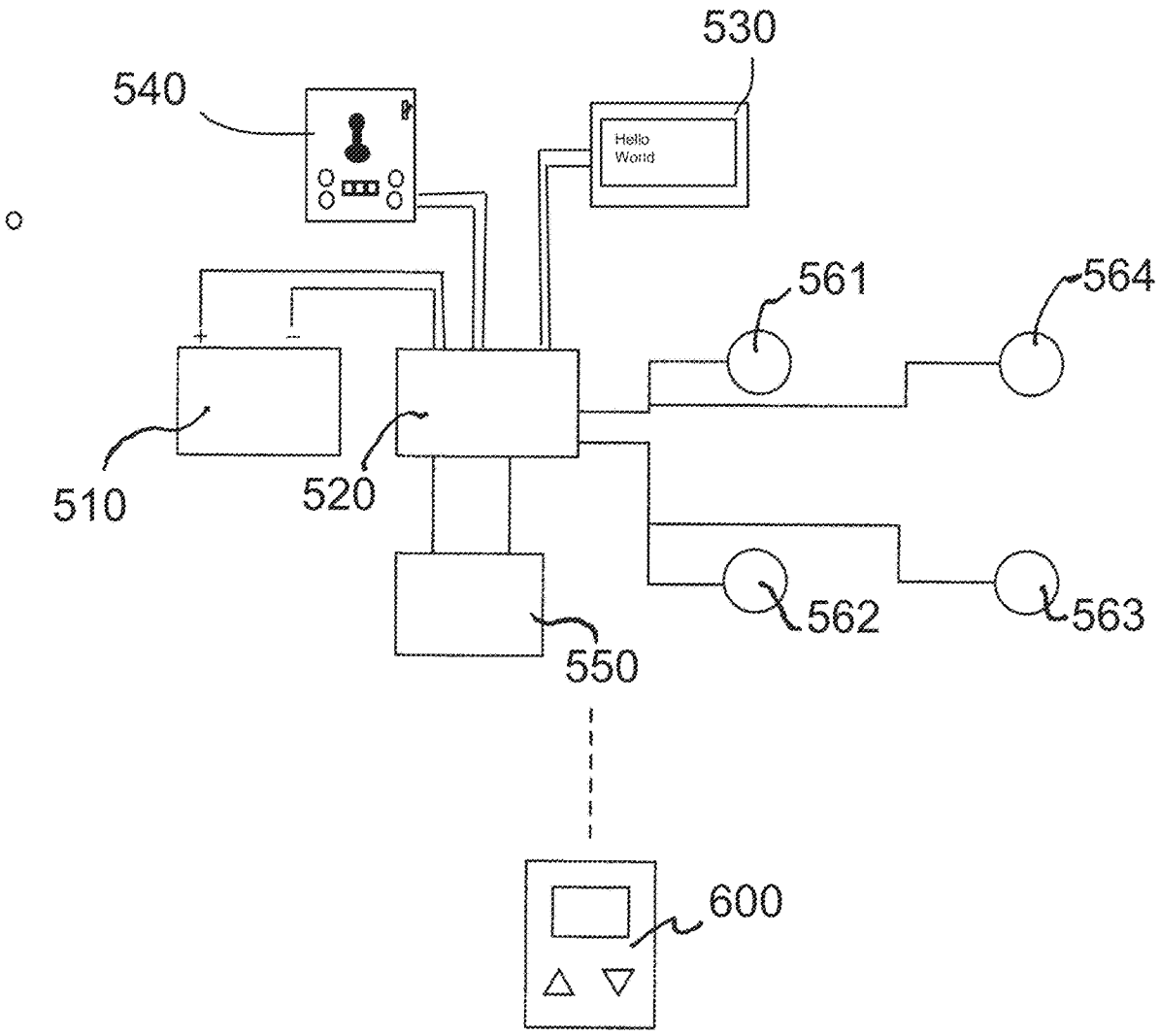
FIG. 22 is a block diagram of controls and leveling electronics that may be incorporated in some or all embodiments of the wheelchair lift.
Figure 23:
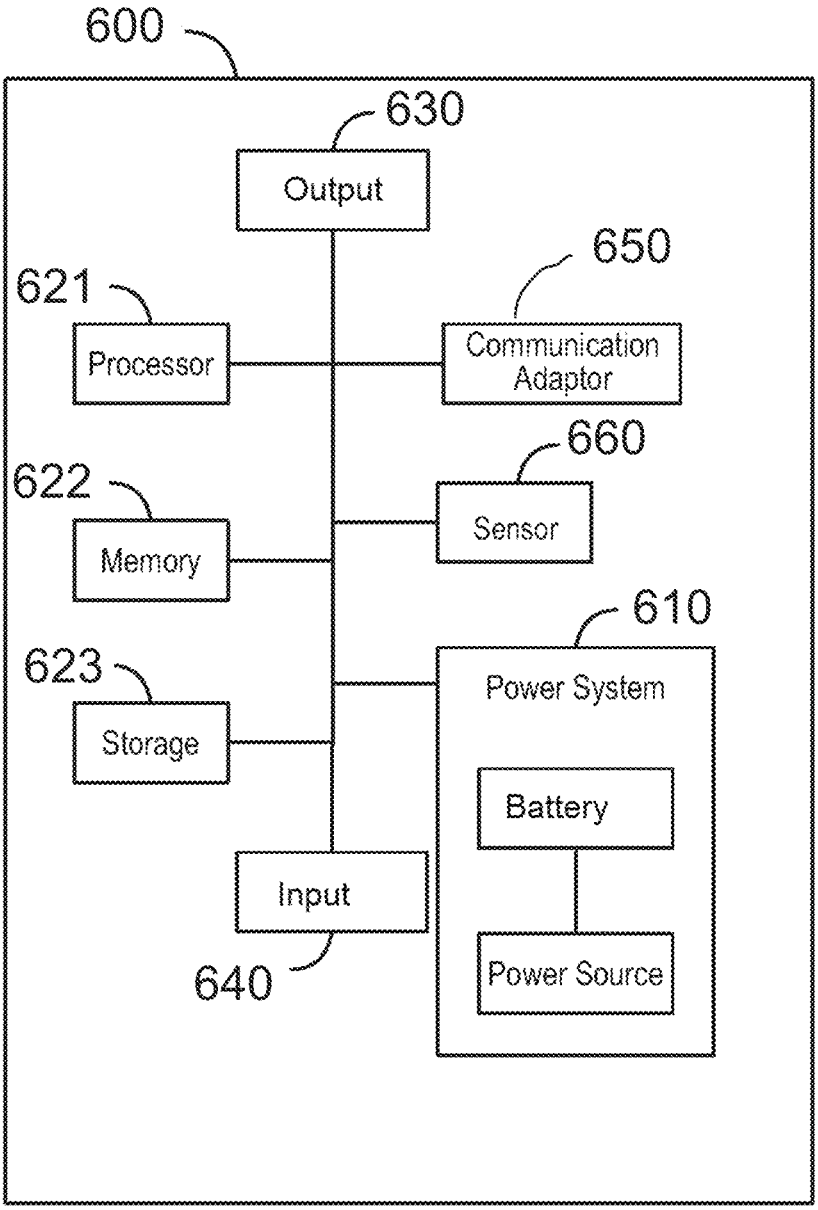
FIG. 23 is a block diagram of various electronic components that may be incorporated in some or all embodiments of the controller for use with the wheelchair lift.

Illustrated in FIGS. 1-23 are various details, features, or use cases of various embodiments of the wheelchair lift 100 and components thereof. FIGS. 1-8 are various views of a first embodiment of a portable wheelchair lift 100. FIGS. 9-15 are various views of a second embodiment of a portable wheelchair lift 200 that is foldable. FIGS. 16-17 are views of a third embodiment of a portable wheelchair lift 300 that is foldable and includes a rotary turntable platform 302. FIGS. 18-21 are various views of a fourth embodiment of a portable wheelchair lift 400 with a smaller footprint. FIG. 22 is a circuit diagram of a control and leveling block that may be incorporated in a portable wheelchair lift 100, 200, 300, 400. FIG. 23 is a block diagram of a controller that may be used to operate portable wheelchair lift 100, 200, 300, 400.

Illustrated in FIGS. 1-8, the portable wheelchair lift 100 comprises a movable lift assembly (comprising front and rear support plates 16, 18 in the first embodiment as shown in FIGS. 1-8), a plurality of front 6, 10 (see FIG. 2) and rear 4, 8 (see FIG. 2) motorized lifting jacks beneath front 12 and rear 13 jack covers, a base plate or stationary platform 2 (stationary relative to the movable lift assembly while raising or lowering), a battery or power supply 62 (or 510 in FIG. 22), and a lift controller/receiver 600 (see FIG. 22). The front and rear support plates 16, 18 (movable lift assembly) are attached to the stationary platform 2 by the lifting jacks 4, 6, 8, 10, and the front and rear support plates 16, 18 can be raised and lowered relative to the stationary platform 2 by the lifting jacks 4, 6, 8, 10.

Figure 1:
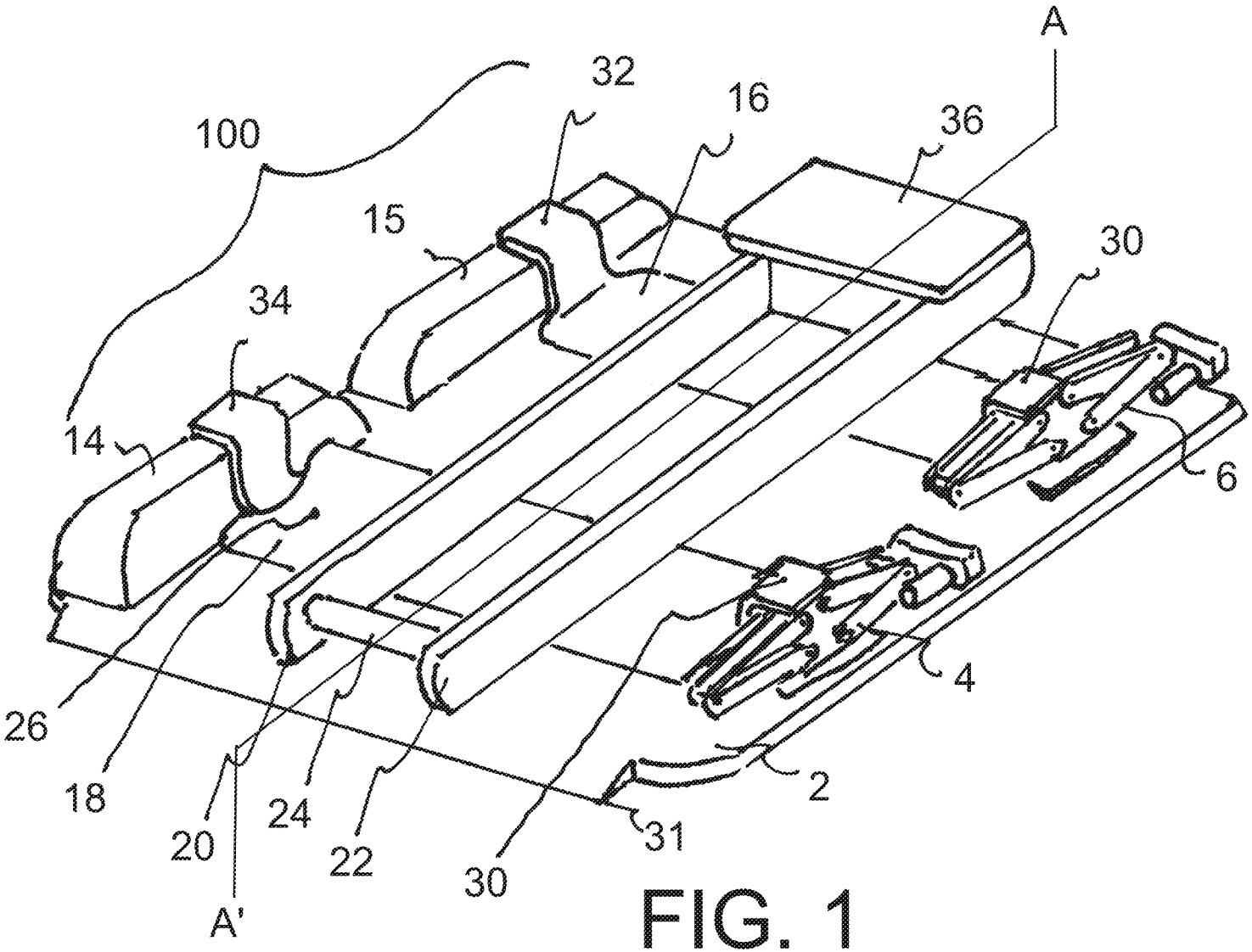
FIG. 1 is a perspective view of the wheelchair lift in the lowered position.

FIG. 1 shows a perspective view of the wheelchair lift in the lowered position. A base plate 2 sits on the ground to provide a stable platform for the lift. Rear right lifting jack 4, front right lifting jack 6, rear left lifting jack 8, and front left lifting jack 10 are connected to the top side of base plate 2. Front support plate 16 is connected between front left lifting jack 10 and front right lifting jack 6 by Z brackets 30, 32 above base plate 2. Rear support plate 18 is connected between rear left lifting jack 8 and rear right lifting jack 4 by Z brackets 28, 30 above base plate 2 and positioned behind front support plate 16.

Although the embodiment depicted in FIG. 1 includes front and rear support plates 16, 18, an alternate embodiment could instead include left and right support plates, a unitary support plate, or separate support plates for each wheel of the wheelchair or each jack 4/6/8/10. In an alternate embodiments, instead of support plates, each wheel may instead be supported by a front and rear crossbar close enough that the associated wheel is suspended by the two contact points with the bars, reducing support materials and therefore reducing the weight that must be lifted along with the wheelchair. In another embodiment, instead of capturing the wheels, the movable lift assembly may instead support or engage a structural element of the wheelchair, such as a crossbar or frame element.

All four lifting jacks 4, 6, 8, 10 are concealed and protected beneath jack covers 12, 13, 14, 15 (right side jack covers 14, 15 are omitted from FIG. 1 to show right side jacks 4, 6) respectively when the jacks are in the lowered position. A foot standing plate 36 is aligned with the wheelchair occupant's feet, toward the front of the wheelchair lift 100. In the present embodiment, a plurality of longitudinal support members 20, 22 connect the top of front support plate 16 to the top of rear support plate 18 and the bottom of foot standing platform 36 (which is attached by a hinge 60—see FIG. 3), stabilizing and strengthening the movable lift assembly. In other embodiments, the longitudinal support members 20, 22 are constructed and configured to be flush with the tops of the support plates 16, 18, which would provide a lower foot standing platform 36.

As depicted in FIGS. 1-8, the elevated longitudinal support members also functions as a wheel guide, forming a left wheel channel between the left longitudinal support member 20 and the left jack covers 14, 15 and a right wheel channel between the right longitudinal support member 22 and the right jack covers 12, 13. The risk of a wheelchair rotating out of a stable position while on the support plates 16, 18 is severely limited by the vertical or angled walls of the wheel channel (in combination with the concave depression 26 of the rear support plate 18, described later).

The base plate 2, support plates 16, 18, and rigid longitudinal support members 20, 22 are preferably formed of a strong and rigid materials such as steel or titanium and may be either solid or hollow. In some lightweight embodiments, the rigid elements of the lift 100 may be formed of glass-filled injection-molded nylon or carbon fiber panel with a honeycomb core. Other similar lightweight, strong materials may be incorporated in some or all elements of the lift 100. In some embodiments, these rigid elements may include either or both of extruded and injection molded elements. Any of these elements 2, 16, 18, 20, 22 may be coated in another material such as rubber, plastic, foam, paint, or fabric to provide a less industrial appearance and to reduce the risk of injury or damage to people or other objects from falls or bumps.

The wheelchair lift 100 may weigh between fifteen and one hundred pounds. The wheelchair lift 100 may preferably weigh between twenty and fifty pounds. In a further preferred embodiment, the wheelchair lift 100 may weigh between twenty-five and thirty-five pounds. The light weight of the wheelchair lift 100 makes it easy to be stored, positioned, adjusted, rolled, and lifted from one location to another location and to perform wheelchair occupant repositioning tasks.

In the present embodiment, handle portion 24 is attached between rigid, longitudinal support members 20, 22. The handle 24 allows a person to either roll the lift like a dolly or suitcase or lift the entire lift 100. Handle 24 may be constructed primarily of the same material as rigid, longitudinal support members 20, 22. Alternatively, handle 24 may be formed of a different material to reduce weight or improve handfeel (e.g., handle 24 may be constructed of wood or a wood piece surrounding a metal core to reduce the industrial feel and to provide a "warmer" contact point for caregivers). Handle 24 may include a comfortable cover such as rubber, plastic, foam, or fabric. In alternate embodiments, handle 24 could be built directly into base plate 2. In still another alternate embodiment, the handle 24 may extend from the body similar to some luggage handles to provide adjustable handle height and to allow a person transporting the lift 100 to angle the lift 100 for easy transportation.

Figure 2:
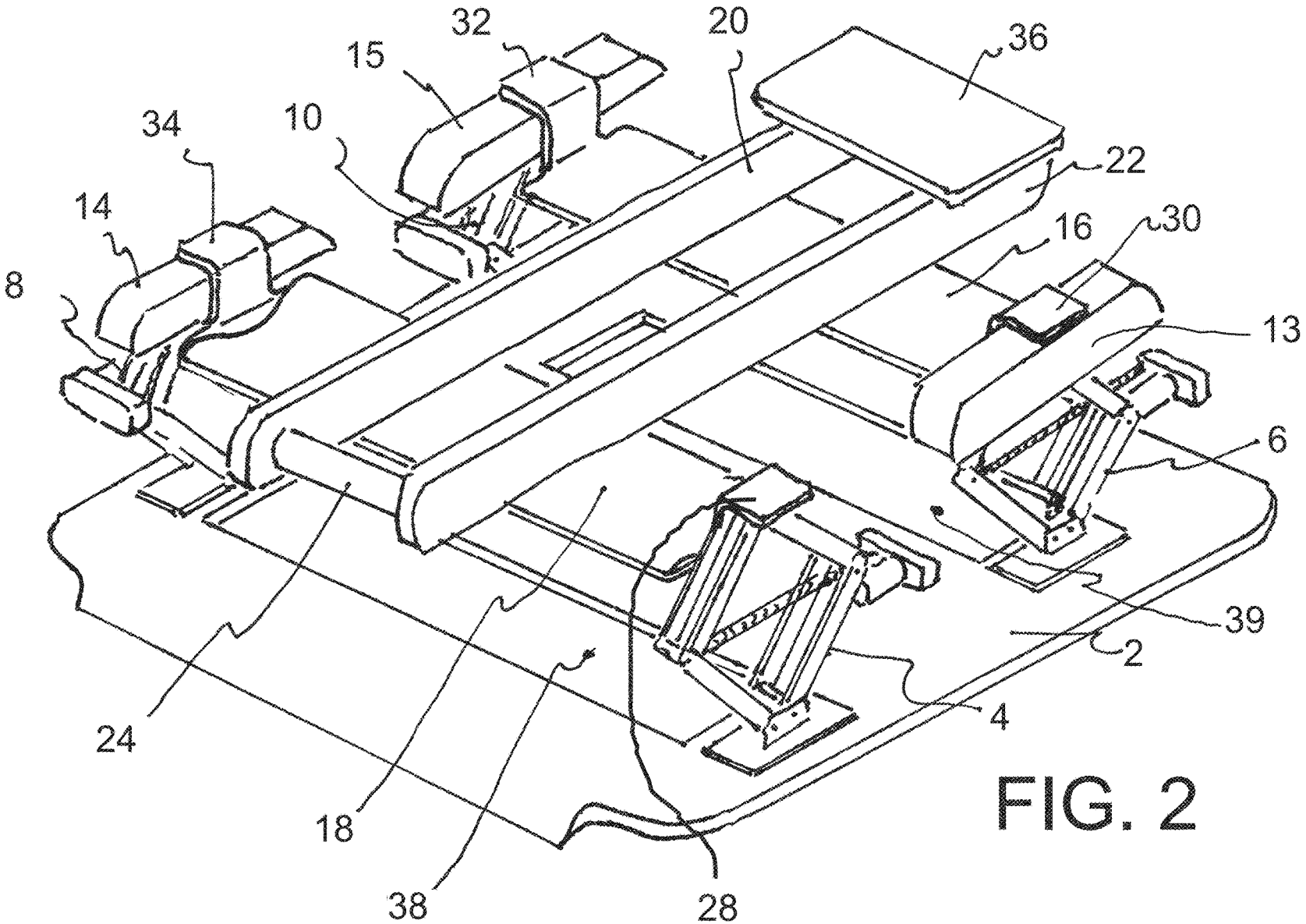
FIG. 2 is a perspective view of the wheelchair lift in the raised position.

FIG. 2 illustrates the wheelchair lift 100 in a raised position with support plates 16, 18 elevated approximately fourteen inches above the ground. In the elevated position, all four jacks 4, 6, 8, 10 are visible. Jack cover 12 is not shown in FIG. 2 to show the interior lifting jack 4, though jack cover 13, 14, and 15 are depicted. FIG. 2 also depicts the position of the foot standing plate 36 when the lift 100 is in the raised position, aligned with a wheelchair occupant's feet if and when he or she is helped to stand up while the lifting mechanism is in the raised position.

As depicted in FIG. 2, when lifting jacks 4, 6, 8, 10 extend and support plates 16, 18 are raised, cavities 38, 39 become visible. In the lowered position, support plates 16 and 18 are positioned inside of cavities 38 and 39 of base plate 2, allowing the support plates 16, 18 to rest lower and provide a level top rolling surface with the top of base plate 2. Cavities 38, 39 also reduce the total weight and material cost of the wheelchair lift. In some embodiments, cavities 38, 39 extend all the way through base plate 2, while in other embodiments, cavities 38, 39 may extend only partially into the thickness of base plate 2. As depicted (but not numbered) in FIG. 2, in some embodiments, base plate 2 includes a cross-member between cavity 38 and cavity 39, while in other embodiments, both support plates 16, 18 may extend from a single joint cavity.

In a preferred embodiment, the wheelchair lift 100 can safely lift a wheelchair and user at least 12 inches off the ground; however, alternate embodiments of the wheelchair lift 100 may be constructed and configured with varying maximum heights anywhere from a few inches to a few yards above the ground.

Micro switches in each jack 4, 6, 8, 10 cause the jack motors to turn off automatically when the jack reaches its upper most position or lower most position, and these micro switches may also be triggered to stop all jacks 4, 6, 8, 10 or a subset of jacks 4, 8 based on pre-set heights (e.g., MRI machine height, CT machine height, physical therapy machine height, or ambulance height) or user input received through the controller/receiver 600 (see FIG. 22). In some embodiments, wheelchair lift 100 elevates between two or more fixed positions (e.g., fully lowered and fully raised). In a preferred embodiment, the wheelchair lift 100 can raise or lower to presets but also includes a manual control for optimized positioning, allowing the lift 100 to lift support plates 16, 18 to any elevation between fully lowered and fully raised positions.

When the jacks 4, 6, 8, 10 are raised and lowered at a common rate, the support plates 16, 18 raise at an equal rate, maintaining the wheelchair at the same pitch as if it were resting on the ground. When some jacks 6, 10 are raised at one rate while other jacks 4, 8 are lowered, remain stationary, or are raised at a different rate than the support plates 16, 18 may angle the wheelchair forward, back, left, or right, or a combination thereof. In some embodiments, the wheelchair lift has a standing-assist mode which includes raising the jacks 4, 6, 8, 10 to different heights to assist the wheelchair occupant in sliding forward and standing up on either the ground or the foot standing platform 36.

For a person with limited mobility, the wheelchair lifts disclosed herein 100, 200, 300, 400 can be used to lift a wheelchair occupant from a sitting position to a standing position by having the person, while sitting in a wheelchair, put his or her feet on the floor directly in front of the wheelchair lift (not on the foot standing platforms 36 of some embodiments). In this position, caregivers can assist wheelchair occupants to a full standing position without straining the caregivers' backs.

Base plate 2 may be as thick as is necessary to provide a sturdy, stable base, which expressly incorporates base plates that are up to and even beyond 1 inch thick. In a preferred embodiment, base plate 2 is between one eighth and three eighths of an inch thick. In an exemplary embodiment, base plate 2 is one quarter of an inch thick, and may be formed to incorporate a small, built-in ramp 31 on the rear edge providing an inclined transition from ground level to the top of base plate 2 making it easier for a care giver or wheelchair occupant to roll onto the lift 100. In the lowered position, as shown in FIG. 1, the lifting plates 16, 18 may be more of less flush with the top of main support plate 2. A wheelchair can easily and comfortably be rolled up the rear ramp 31 and along the top of base plate 2 to position the wheelchair wheels on top of front and rear support plates 16, 18. Front support plate 16 is positioned and configured to support a wheelchair's front wheel and rear support plate 18 is positioned and configured to support a wheelchair's larger rear wheel. Rear support plate 18 includes a concave wheel depression 26 that helps a user to properly position the wheelchair to be lifted, and acts as a partial brake to maintain the wheelchair's large rear wheel in place throughout the lifting process.

Figure 3:
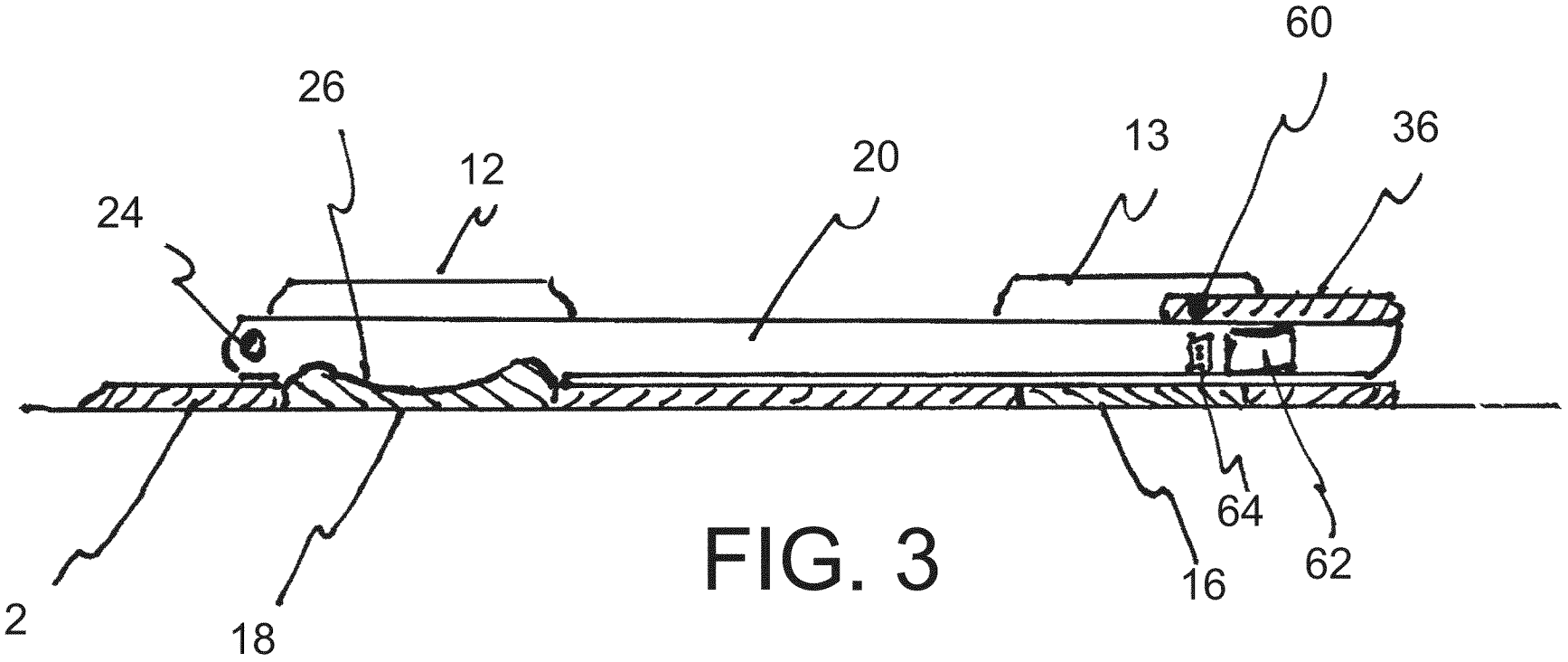
FIG. 3 is a cross-section view taken along line A-A' of FIG. 1 of the wheelchair lift in the lowered position.
Figure 4:
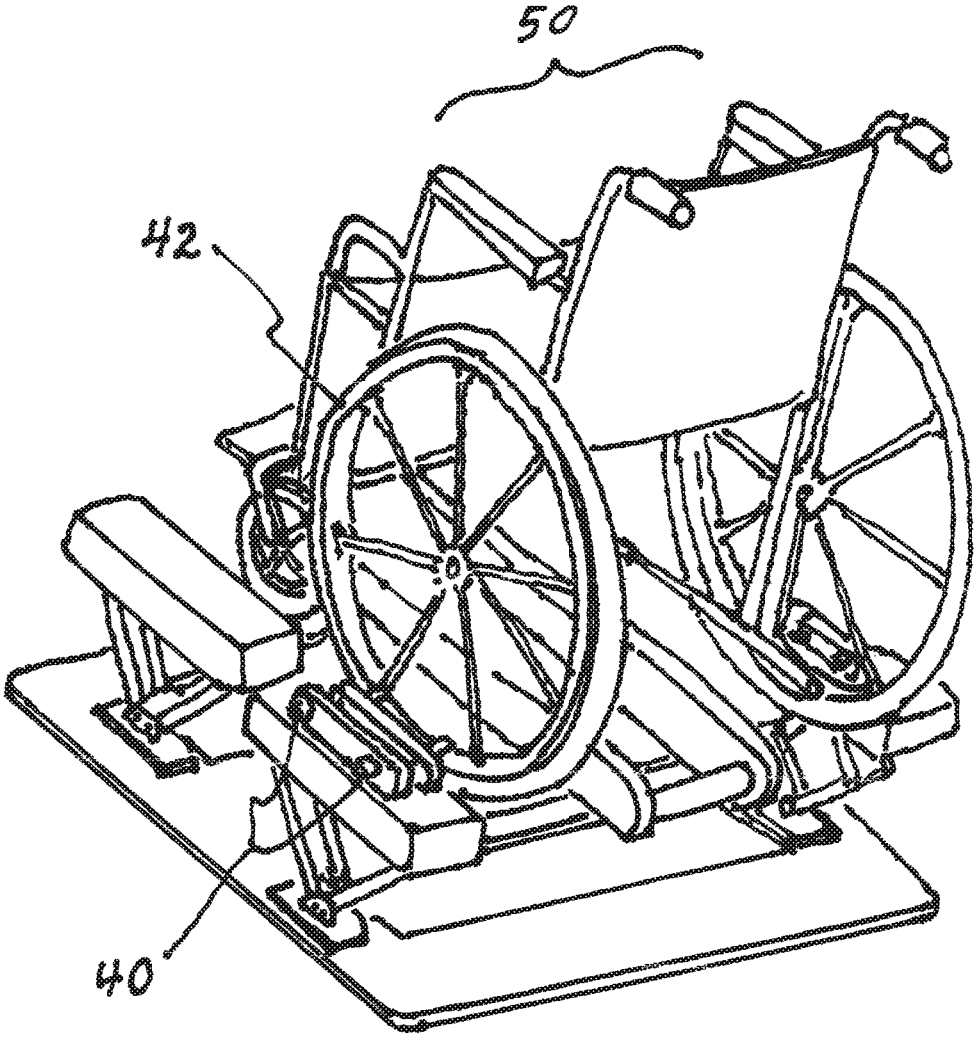
FIG. 4 is perspective view of the wheelchair lift supporting a wheelchair in the raised position.

FIG. 3 is a cross-section view of the wheelchair lift 100 taken along line A-A' of FIG. 1. As depicted in FIG. 3, lifting plates 16, 18 are flush or nearly with the top of the main support plate (base plate) 2. The concave depression 26 provides a front and rear lips for lift plate 18, functioning as a guide and cradle for the large wheel of a wheelchair as shown in FIG. 4. This concave depression 26 positions the wheelchair and functions as a partial brake. Additionally, FIG. 3 clearly depicts the height of the longitudinal support members 20 (and 22, not shown) compared to the height of the base plate 2 and the support plates 16, 18. Foot standing plate 36 can be seen as well as jack covers 12, 14. FIG. 3 also depicts electronic components 64 and battery 62. Battery 62 provides power to raise and lower the jacks 4, 6, 8, 10 and to receive user commands and provide user feedback through controller/receiver 600. The battery 62 and control electronics 64 may be accessed beneath foot plate 36, which may be pivoted or lifted at hinge member 60.

The battery 62 used to power wheelchair lift 100 is preferably rechargeable and has a high energy density. The rechargeable battery 62 may be a nickel cadmium battery, a nickel metal hydride battery, a lead acid battery, a lithium ion battery, a lithium polymer battery, a solid state battery, or any other rechargeable battery. though the lift 100 may incorporate redundant batteries or external power sources. The lift 100 may also include a power adaptor, capable of drawing power from a wall socket, a standard power/data port (e.g., USB, USB type-C, lightning, or a vehicle port (e.g., USB or cigarette 12V adaptor). In some aspects, the battery 62 may be charged while the lift 100 is in use or in storage. In some aspects, the battery 62 may be removed and swapped, and the battery 62 may be charged outside of the wheelchair lift 100. In some aspects, the wheelchair lift 100 is powered by a multipurpose rechargeable battery 62 that can be used in other medical devices or electronics. In an alternate embodiment, the wheelchair lift is powered by fuel cells or super-capacitors.

FIGS. 4-8 depict some components of the first embodiment of the wheelchair lift 100 that were omitted from FIGS. 1-3 to better view and understand the structure of other elements of the lift 100. FIG. 4 is a perspective view of a 3-D model of the wheelchair lift 100 with a wheelchair 50 locked in place by locking mechanism 40. FIGS. 5-8 are top, perspective, side, and end views of the wheelchair lift 100 clearly depicting the position of the locking mechanisms 40 and the position of the castors 44, 46 attached to a perpendicular plate 48. Perpendicular plate 48 may be secured to base plate 2, to standing foot platform 36, or to longitudinal support members 20, 22. In an alternate embodiment, the castors may be mounted directly to the base plate 2, the standing foot platform 36, or to longitudinal support members 20, 22.

Figure 5:
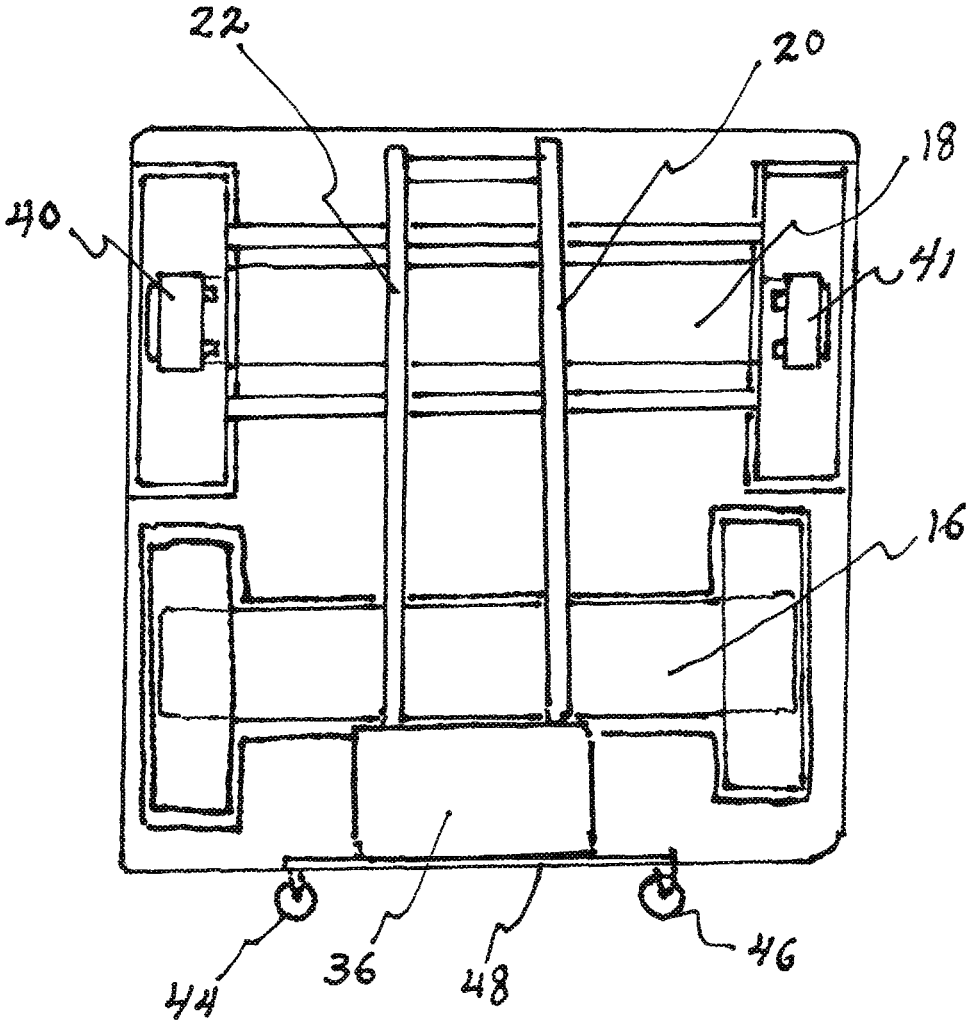
FIG. 5 is a top view of the wheelchair lift.
Figure 6:
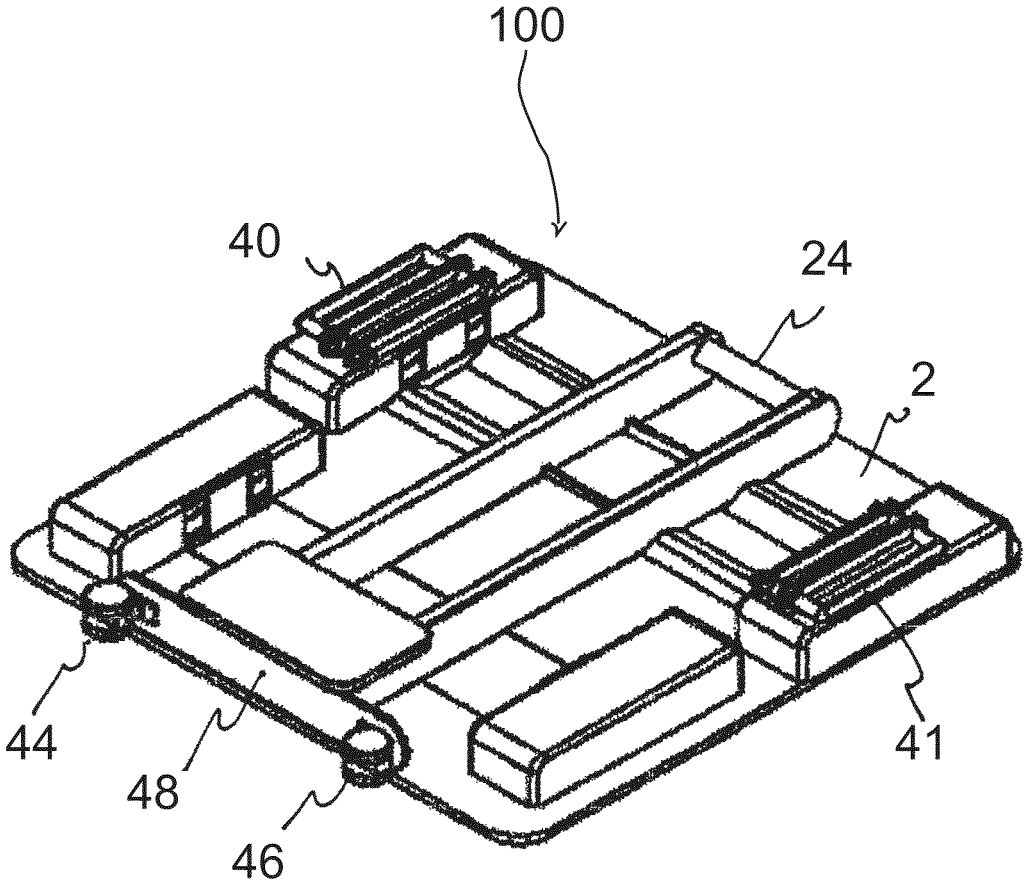
FIG. 6 is a perspective view of the wheelchair lift with castors.
Figure 7:
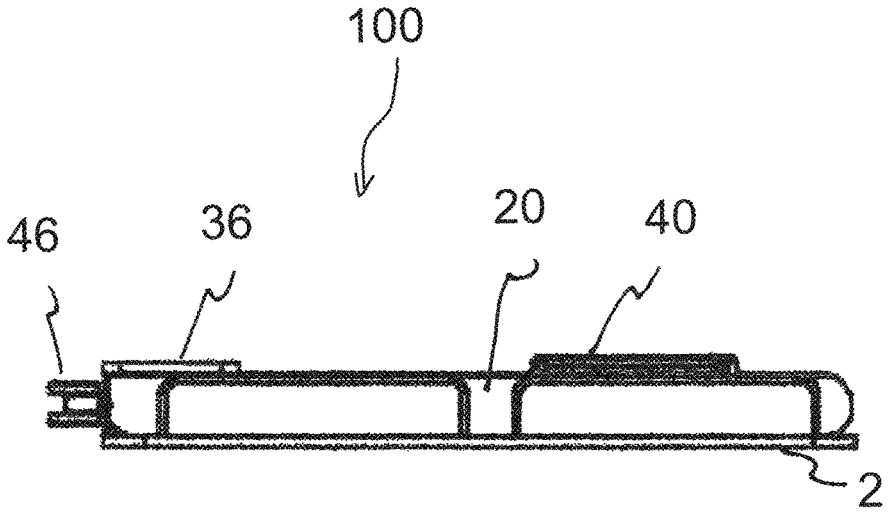
FIG. 7 is a side view of the wheelchair lift in the lowered position.
Figure 8:
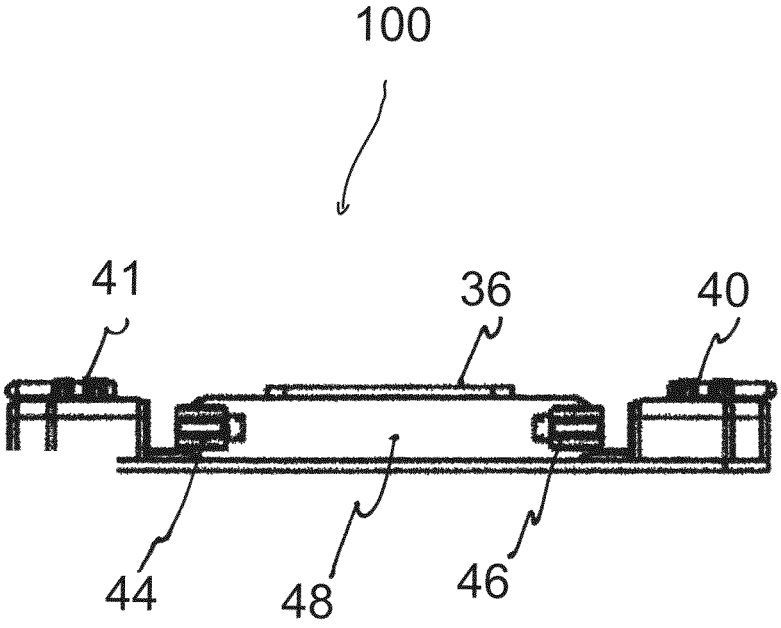
FIG. 8 is a front view of the wheelchair lift in the lowered position.

The wheel locking mechanism 40 as shown in FIGS. 4 and 5 comprises sliding fingers which engage the grip wheel 42 on the wheelchair 50, thereby preventing the wheelchair 50 from rolling off of support panels 16, 18. Locking mechanism 40 may be positioned on top of the rear jack covers or Z brackets. Though not easily visible in FIG. 4 through the wheels of the wheelchair 50, a second locking mechanism 40 is positioned on rear right jack cover 12, similar to the locking mechanism 40 positioned on rear left jack cover 14. In an alternate embodiment, fingers 41 may instead engage the wheels 50 or spokes directly.

Although not depicted in the figures, in some embodiments it may improve the usability and operation of the wheelchair lift to include a rolling capability on the underside of the base plate 2. This rolling capability may be accomplished by adding casters or standard wheels. These wheels may freely rotate to enable the lift 100 to be moved laterally in any direction. In an alternate embodiment, instead of wheels, the underside of the base plate 2 incorporates spherical rollers, positioned and configured to allow the lift 100 to be smoothly and easily moved across the surface of the ground. Either the wheels, casters, or balls may include a mechanism enabling the wheels to support the lift 100 when the lift is unencumbered, but locking or disengaging the wheels, casters, or balls if and when a weight (such as a wheelchair or person) is loaded onto the lift 100. This mechanism could be a tuned suspension that supports the weight of the device, but that is incapable of supporting any additional weight. Alternatively this mechanism could allow the wheels, casters, or balls to recede into the underside of base plate 2 when pressure is applied generally or to specific areas of base plate 2, functioning similar to a pen-click.

Illustrated in FIGS. 9-15, the second embodiment of the portable wheelchair lift 200 comprises a foldable lifting platform (comprising right and left halves 202, 204), a plurality of motorized lifting jacks 234, 236, 238, 240 beneath right and left molded jack covers 230, 232, right and left rigid metal panels 270, 272 providing a stable base, a battery or power supply 62 (or 510 in FIG. 22), and a lift controller/receiver 600 (see FIG. 22). The right and left halves of the foldable lifting platform 202, 204 are attached to the right and left rigid metal panels by the lifting jacks 234, 236, 238, 240, and the right and left halves of the foldable lifting platform 202, 204 can be raised and lowered relative to the right and left rigid metal panels by the lifting jacks 234, 236, 238, 240.

Figure 9:
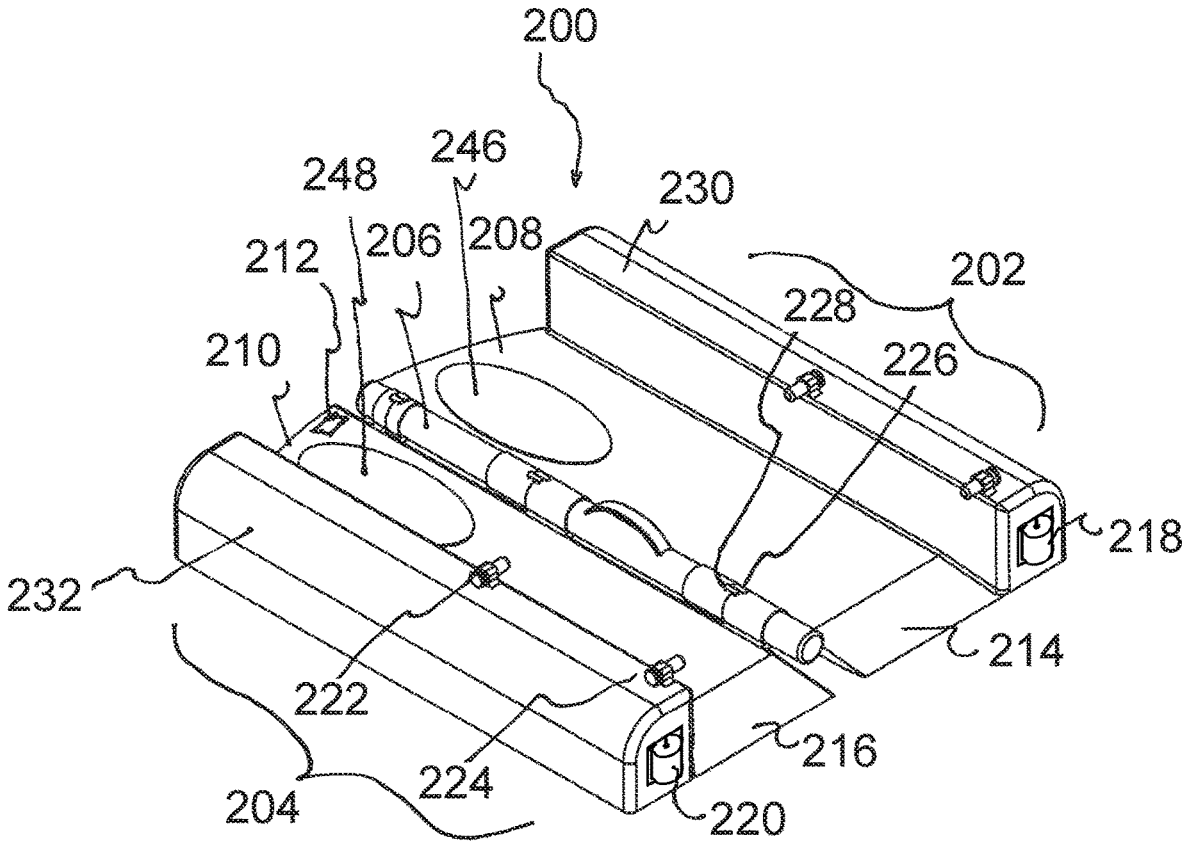
FIG. 9 is a perspective view of a second embodiment of the wheelchair lift in the open position.

FIG. 9 is a perspective view of a second embodiment of the wheelchair lift 200. In this embodiment, the lifting platform is divided into right and left halves 202, 204 connected by a central folding hinge member 206. A pair of non-slip foot pads 246, 248 are mounted to the right and left lifting platform halves 202, 204, providing a non-slip surface for a wheelchair occupant when he or she stands up on the lifting platform, and the rear end of each platform lifting half 202, 204 includes an integrated platform ramp 214, 216. Locking tabs 226, 228 overlap each other to prevent the right and left lifting platform halves 202, 204 from flexing upward during use. An operator may easily unlock the locking tabs 226, 228 by hand to fold and transport or store the wheelchair lift 200. Slide posts 222, 224 lock rear wheel in position during use, similar to wheel locking mechanism 40 in the first embodiment of wheelchair lift 100. Right and left molded jack covers 230, 232 include castors 218, 220 which allow a user to roll the entire wheelchair lift assembly 200 during transport.

Because many wheelchair occupants are not capable of standing on a scale to determine their weight, the wheelchair lift may incorporate a weight sensor or measuring device 210 beneath the platform halves 226, 228 and a digital readout 212 mounted on one of the halves and configured to display the weight of the user or the weight of the user and the chair while on the lift. In some embodiments, the weight sensor may comprise a plurality of load cells. In some embodiments, the plurality of load cells are configured in a full wheatstone bridge or half wheatstone bridge. In some embodiments, the load cells are positioned between the jacks 234. 236. 238, 240 and the molded jack covers 230, 232. In alternate embodiments, the load cells are positioned between the jacks 234. 236. 238, 240 and the outer rigid metal panels 260, 262. The load cells may be positioned and secured anywhere on any of the lift embodiments 100, 200, 300, 400 capable of detecting a weight located on the top surface of the lift.

The user's weight can be determined by measuring the weight of the user and the wheelchair together while on the platform halves 226, 228, and then subtracting the weight of the chair. In some cases where standardized wheelchairs are used, the math may automatically deduct the pre-set weight of the standardized wheelchair. In other cases where various wheelchairs are used, the weight of the wheelchair is manually obtained when the wheelchair occupant has been transferred to another support surface (e.g., bed, chair, vehicle, or medical test equipment) to complete the calculation.

In some embodiments, the wheelchair lift 200 may include a wheelchair recognition sensor and may recognize the standard weight of each common recognized wheelchair to quickly provide weight calculations. This sensor may include optical recognition, barcode scanning, or wireless detection such as scanning and retrieving information from an RFID chip included in the wheelchair. The wheelchair lift may initially estimate occupant weight based on the automatically retrieved wheelchair weight, but will later complete the accurate calculation once the occupant has transferred to another surface and an accurate weight of the supported wheelchair can be captured (possibly including additional weight in blankets, pillows, or pocket contents.

Figure 10:
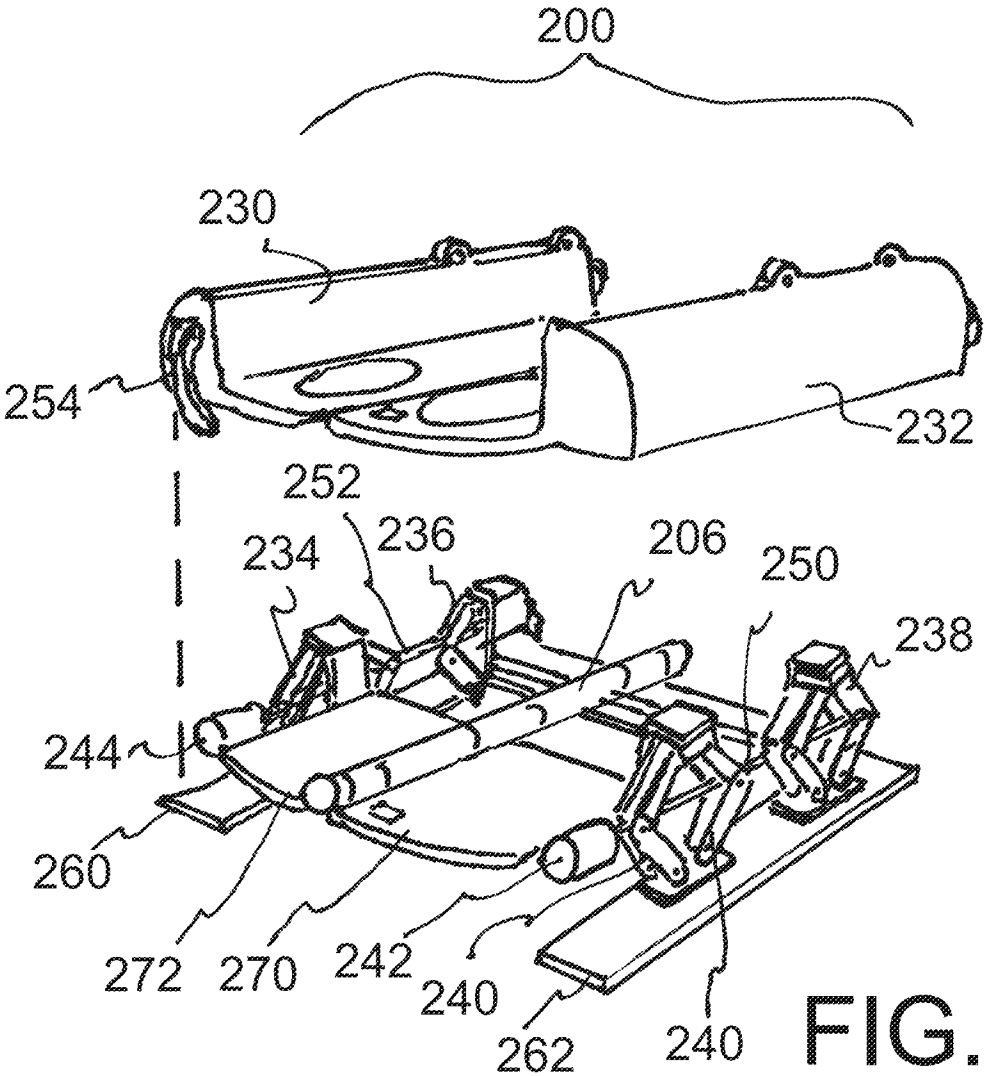
FIG. 10 is an exploded view of the second embodiment of the wheelchair lift.
Figure 11:
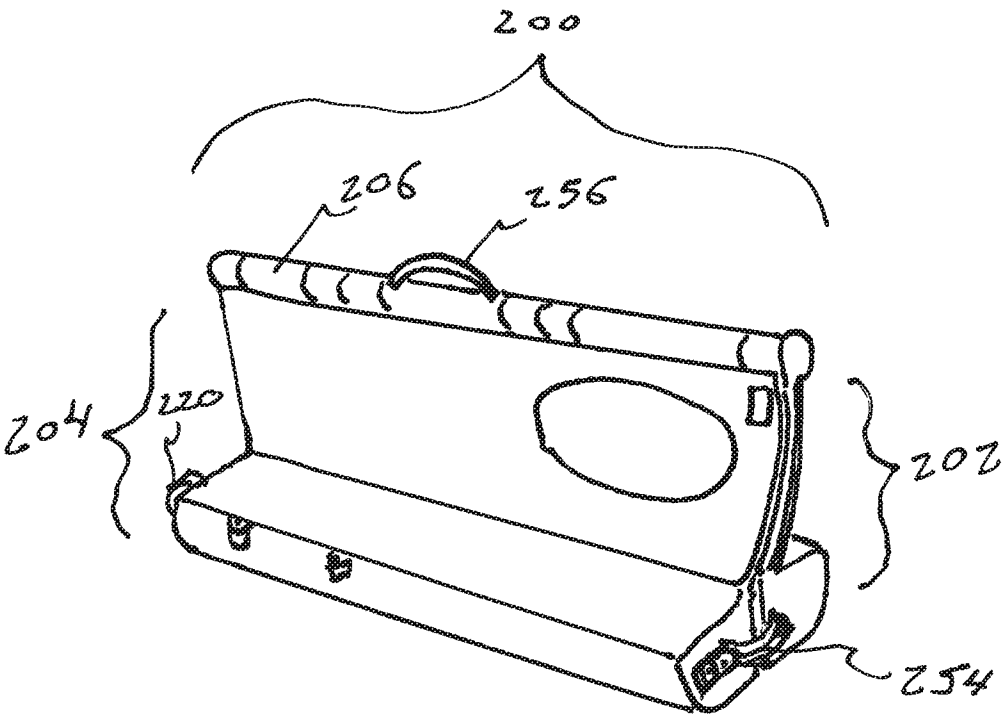
FIG. 11 is a perspective view of the second embodiment of the wheelchair lift in the folded position.

FIG. 10 is an exploded view of the second embodiment of the wheelchair lift 200. Molded cover members 232, 230 cover inner rigid metal panels 270, 272, which are secured to the tops of lift jacks 234, 236, 238, 240 by Z-brackets (not numbered). The lift jacks 234, 236, 238, 240 are additionally secured to the tops of outer rigid metal panels 260, 262. Lift jacks 234, 236, 238, 240 operate in a similar fashion to those of the first embodiment 100; however, in the present embodiment left side lift jacks 238, 240 are operated by a single first motor 242 and lead screw 250, and the right lift jacks 234, 236 are operated by a single second motor 244 and lead screw 252. As lift jacks 234, 236, 238, 240 raise, inner rigid panels 270, 272 raise up relative to outer rigid panels 260, 262. As inner rigid panels 270, 272 is raised, right and left halves 202, 204 are also lifted. FIG. 10 also depicts the side of right and left molded jack covers 230, 232 opposite the castors 218, 220, where a handle attachment 254 is fixed to the end of right jack cover and a handle attachment point (not shown) is present on the end of left jack cover 232. When wheelchair lift 200 is in a folded position (see FIG. 11), handle attachment 254 may be attached to the handle attachment point, providing both additional strength holding the halves in the folded position and a convenient handle for rolling the wheelchair lift 200.

Figure 12:
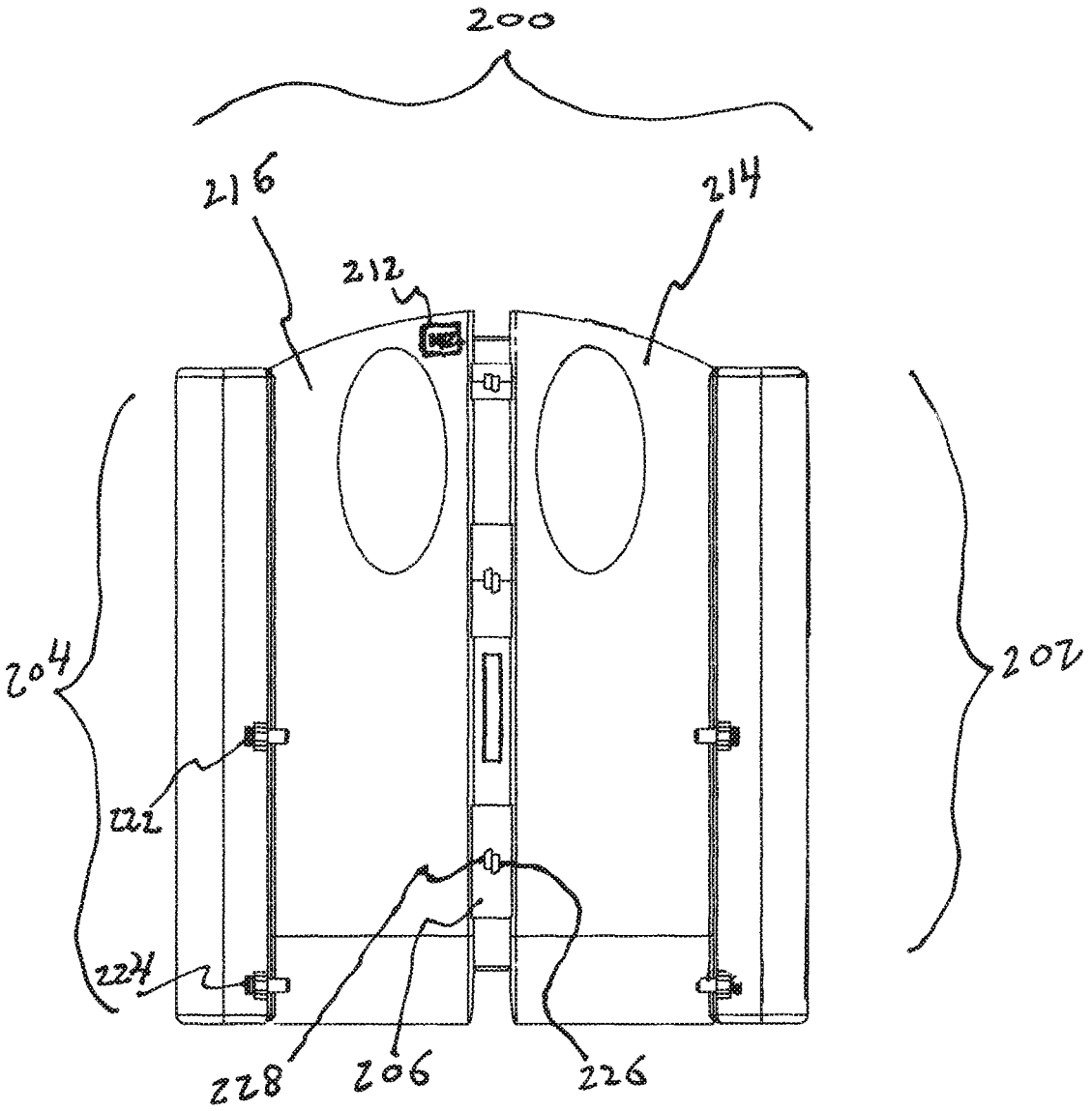
FIG. 12 is a top view of the second embodiment of the wheelchair lift in the open position.
Figure 13:
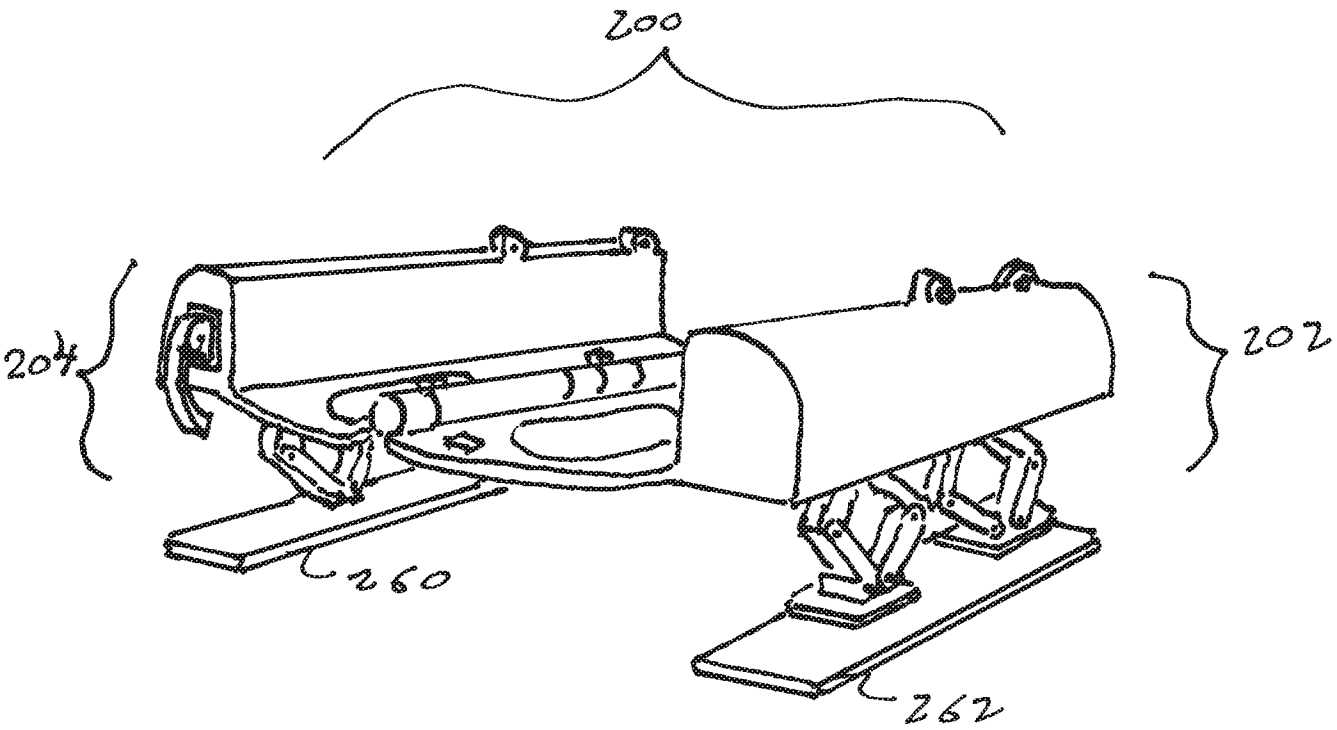
FIG. 13 is a perspective view of the second embodiment of the wheelchair lift in the up position.
Figure 14:
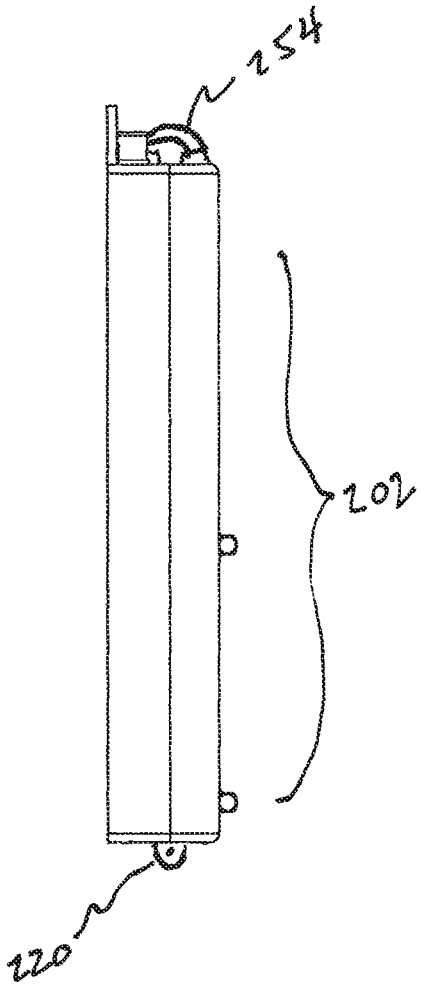
FIG. 14 is a side view of the second embodiment of the wheelchair lift.
Figure 15:
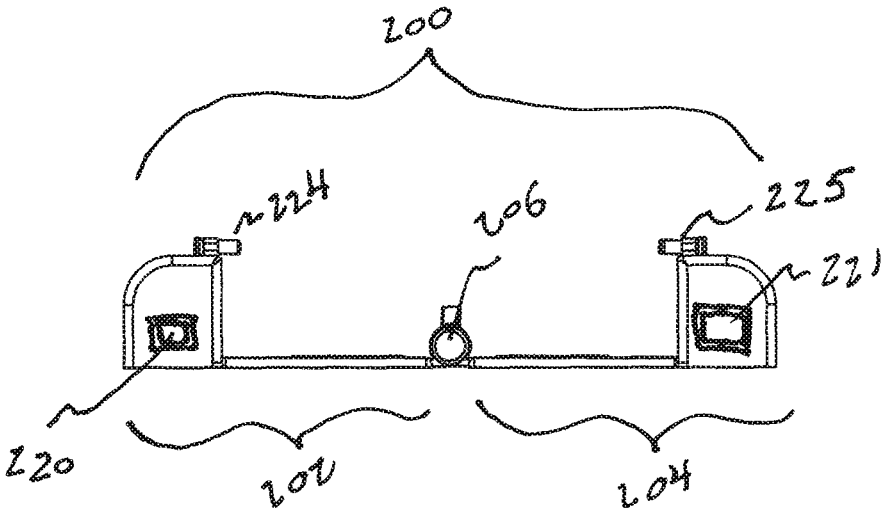
FIG. 15 is a rear view of the second embodiment of the wheelchair lift.

FIGS. 11-15 are folded position perspective, lowered position top, raised position perspective, lowered position side, and lowered position end views of the second embodiment of the wheelchair lift 200. Handle 254 and wheels 220 help a user conveniently roll the wheelchair lift 200 from one location to another. Handle 256 on the central hinge member 206 also helps a user lift and carry the wheelchair lift 200 while in the folded or horizontal positions. FIG. 12 depicts the restraint tabs 228, 226 which prevent the panels 214, 216 from folding up, but allow the panels 214, 216 to fold down for storage or transport. The tabs 228, 226 block each other and prevent further rotation. FIG. 14 is a side view of the wheelchair lift 200 in a vertical orientation, allowing the casters or wheels 220 to roll on the floor while the user holds and pulls or pushes handle 254 located at the top of the folded device 200.

The third embodiment of the portable wheelchair lift 300 (as shown in FIGS. 16-17) is similar to the foldable wheelchair lift of the second embodiment 200, but further comprises a rotary turntable platform 302 centrally mounted toward the front end of the lift (in place of the non-slip foot pads 246, 248 of the second embodiment 200. A wheelchair occupant with partial mobility who is seated in a wheelchair positioned on the lift 300 can place his or her feet on the turntable platform 302. After a caregiver assists the wheelchair occupant from the wheelchair seat to a partial standing position on the turntable platform 302, the platform 302 may be rotated to the left or right to angle and position the (former) wheelchair occupant onto another surface such as an exam table or bed. The rotary platform 302 is fixedly attached to one side of the folded assembly allowing the other side to fold and open about the hinge 306 as desired.

FIGS. 18-21 depict a fourth embodiment of a wheelchair lift 400 with a reduced footprint. This reduced footprint is achieve by mounting the lift assemblies (or lift jacks) 430, 432, 434 and the lift motors 402, 404, 406 between the wheel channels 408, 409. The present embodiment 400 employs three lift jack mechanisms 430, 432, 434 with one jack 430 in the front portion of the wheelchair lift 400 and two jacks 432, 434 in the rear portion of the assembly 400. The use of three lift jacks instead of four reduces the necessary footprint for the jack and motor, allow the jack mechanisms 430, 432, 434 to be placed between the wheel channels 408, 409 and beneath panel 446.

The wheelchair lift comprises a central panel 446 attached to side panels (wheel wells) 408, 409. The central panel 446 may include holes, allowing portions of the lift motors 402, 404, 406 to be positioned beneath the lift panel 446 without requiring significant additional height. Alternatively, central panel 446 may include specific protrusions to allow for additional clearance beneath central panel 446 in the areas above the lift motors 402, 404, 406. Two concave or cutout depressions 420, 422 may be located in the area where the rear wheels of a standard wheelchair will be positioned during lifting operation so that the depressions 420, 422 will act as a partial break, holding the wheelchair in place when lifted. Handle members 414, 416, 418 allow a user to lift and carry the wheelchair lift 400 like a suitcase or to roll the wheelchair lift 400 on rear wheels (not shown, but positioned opposite handle 414), similar to a rolling suitcase.

Figure 19:
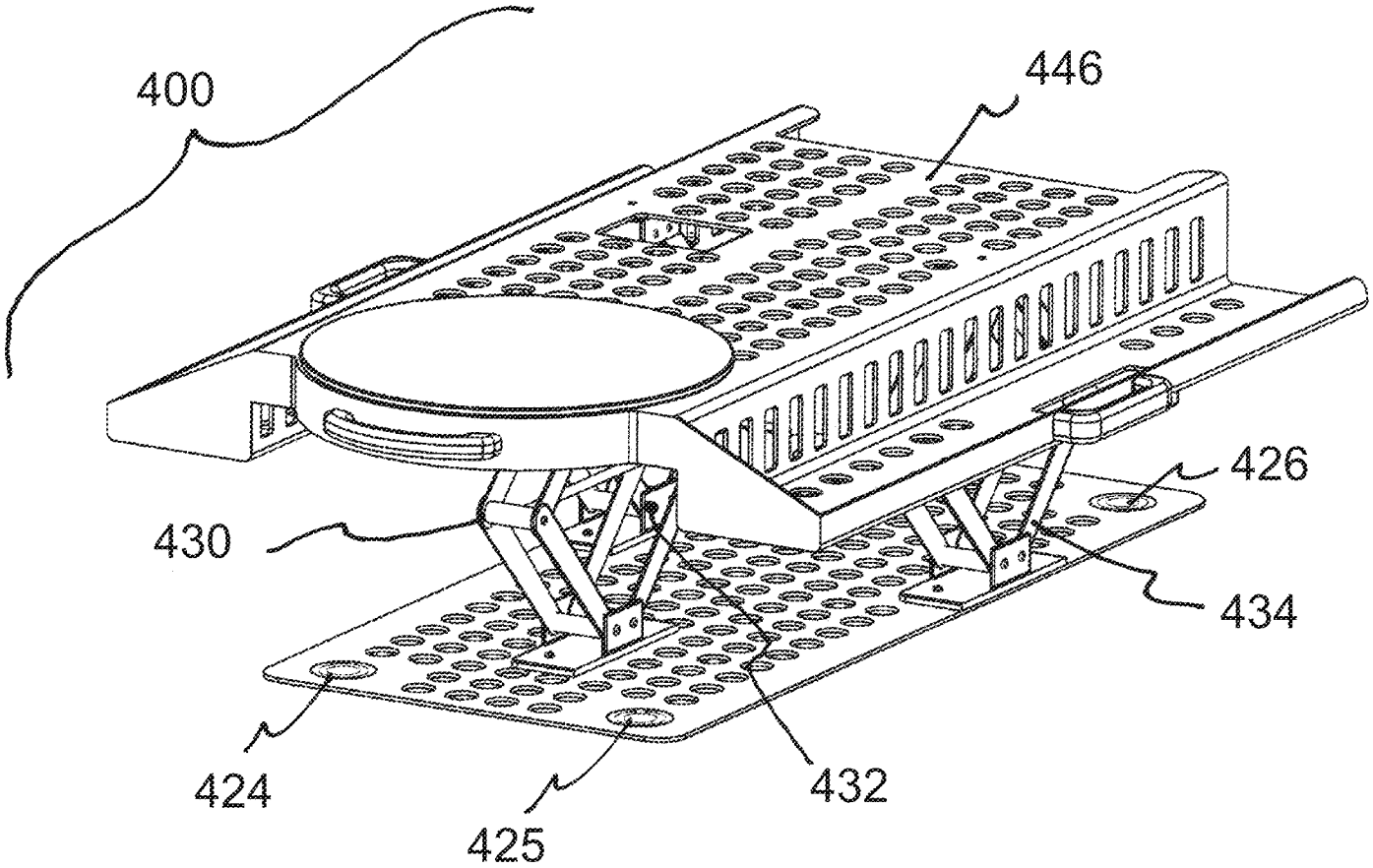
FIG. 19 is a perspective view of the fourth embodiment of the wheelchair lift in the raised position.
Figure 20:
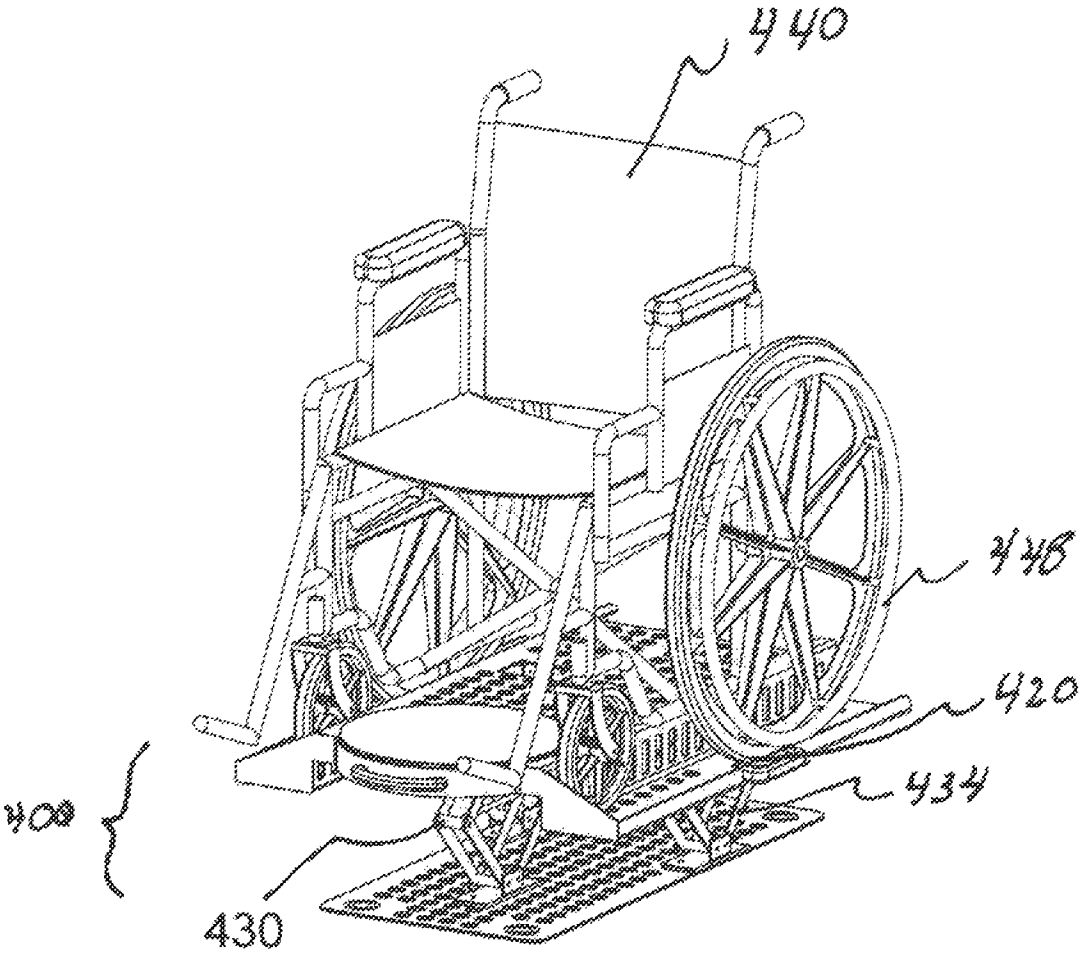
FIG. 20 is a perspective view of the fourth embodiment of the wheelchair lift supporting a wheelchair in the up position.
Figure 21:
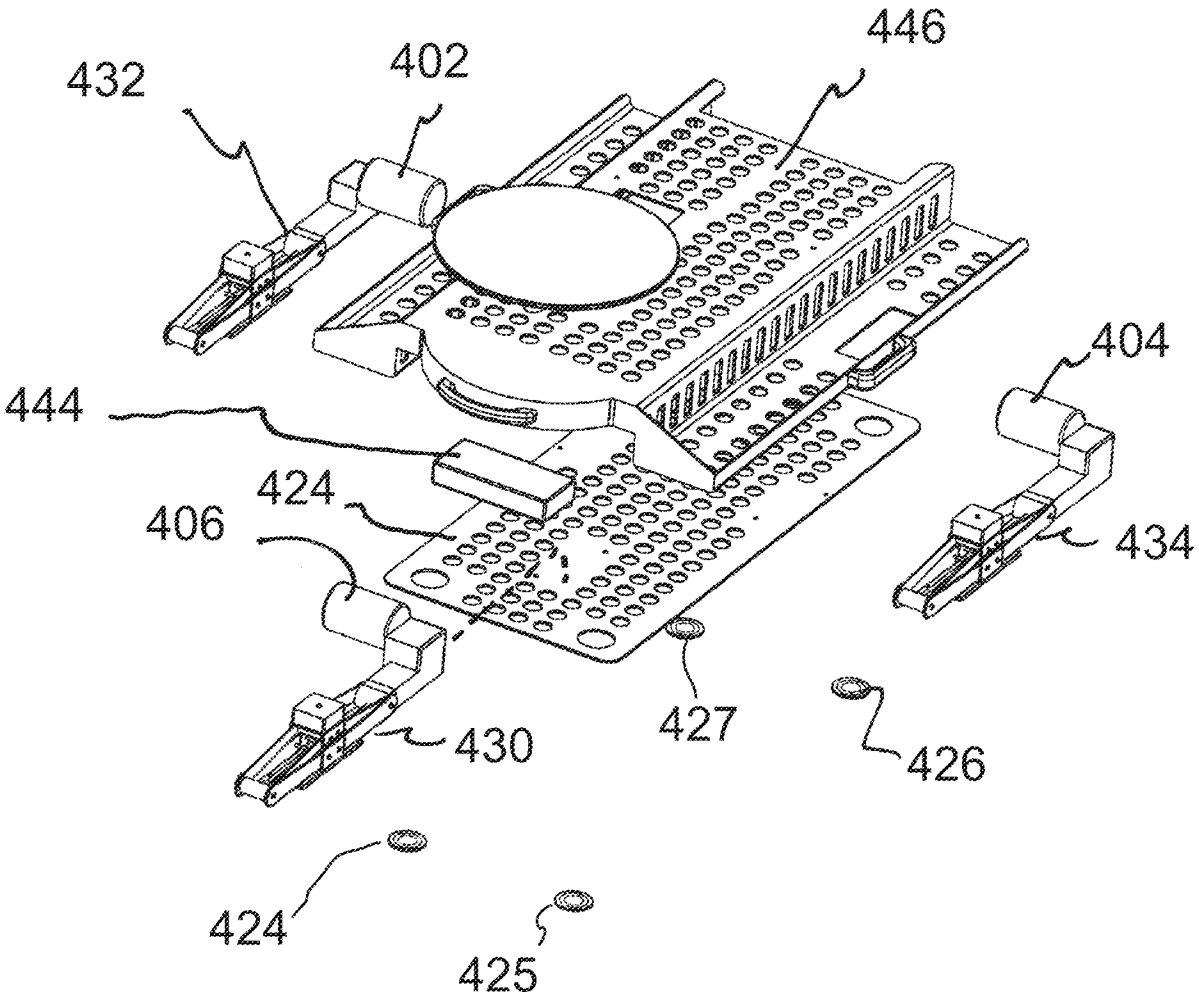
FIG. 21 is an exploded perspective view of the fourth embodiment of the wheelchair lift.

FIG. 19 shows the wheelchair lift 400 in the raised position, revealing four weight measuring transducers 424, 425, 426, 427 (427 visible in FIG. 21), which can be used to measure the weight of people or items on the wheelchair lift 400, similar to the weight sensors described in connection with FIGS. 9-15. In an alternate embodiment, the transducers 424, 425, 426, 427 may be mounted between the lifting jacks The wheelchair lift 400 incorporates a rotary platform 436 similar to the one described in connection with FIGS. 16-17, with generally similar structure and function (aside from foldability). FIG. 20 depicts the internal elements of the wheelchair lift 400 and their locations beneath the central panel 446, including housing 444, which contains electronics including an electronic leveling circuit and a rechargeable battery 62.

FIG. 22 is a block diagram of an example circuit that may be used in any version of the wheelchair lift 100, 200, 300, 400. A battery power supply 510 (previously also 62) is attached by wires to a main circuit board 520. One or more displays (e.g., one or more LEDs, LCDs) 530 and one or more inputs 540 may also be connected to main circuit board 520 and powered by battery 510. Main circuit board 520 may also contain a leveling circuit that uses sensors (e.g., gyroscopes, accelerometers, gravity sensors, or tip sensors) 561, 562, 563, 564 to detect if the support plates 16, 18 are maintaining a level surface for the wheelchair 50, parallel to the ground plane. If the accelerometers or other sensors determine that the support planes are not providing a ground-parallel surface, the leveling circuit adjusts the output (either with a digital signal or by adjusting the power supplied to an analog motor) to each lift motor to return the lift to a level position. Although not shown in FIG. 22, main circuit board 520 may also be connected to the load sensors 424, 425, 426, 427, possibly through an ADC and/or a signal booster. The load sensors 424, 425, 426, 427 may be connected in a wheatstone bridge or half wheatstone bridge. A communications circuit and antenna 550 sends signals to a controller/receiver 600 (or to a mobile device or wearable device) which can be used to adjust or control the wheelchair lift 100, 200, 300, 400.

Preferably all or some of the main circuit board for the wheelchair lift are incorporated into a printed circuit board (PCB) containing various electronic components and circuitry in a compact element. The circuit board is preferably secured and shielded in a shock-resistant, water and dust resistant enclosure and may comprise a MCU (micro-controller or micro-computer unit) module, a WACIO/UART (wide area communications IO/universal asynchronous receiver and transmitter) module, and other circuit components, such as an AC/DC converter/transformer and isolator (for battery charging), a DC/DC regulator for powering the wheelchair lift components at different voltages and currents from a single battery, a high resistant circuit, an input circuit, and an output circuit, described in additional detail below. In the present embodiment, the electrical components should be strategically positioned to avoid electrical interference. For example, high power components (e.g., motor controllers may be positioned at some distance from lower power or sensitive components such as the MCU and wireless communications module and antennae).

A MCU (micro-controller or micro-computer) module may be separate from or built into main circuit board 520 and may serve as the main processor for the wheelchair lift 100 to perform system control and data processing. The MCU receives and processes all data, operating as the brain for the wheelchair lift. The MCU may also include a sleep mode to turn off power after a predetermined time period of inactiveness and thereby may save power when the wheelchair lift is inadvertently left on for extended unused periods. The MCU may interpret any first received signal during a system sleep as a wake command.

A communications module and antenna 550 and associated antenna cable, such as that suitable for Bluetooth, BLE, WiFi, infrared, or any other known wireless standards (or a proprietary wireless communication system) can be placed in the main housing 444 or at the outer portion of the main housing to minimize interference from the motors and motor controllers to the communications abilities. The antenna can be configured to ensure efficient signal propagation, and to pair only with the controller 600. In an alternate embodiment, the antenna and communications module may enable the wheelchair lift to pair with mobile devices such as an smartphone or tablet.

An application software that is installed in a mobile device can be provided to the user to further effectuate the control and to allow the user to set pre-sets, track weight or use frequency, create profiles, or allowing the user to assign "rooms" and "zones" where the user frequents with pre-set heights or sleep profiles.

FIG. 23 is a block diagram of the controller 600, which may connect to the wheelchair lift 100, 200, 300, 400 either wirelessly or through a wired connection. The controller 600 includes a power system (possibly including both a battery and an external power source for charging, recharging, or directly running off of external power) 610, and a micro-controller or micro-computer 620 to interpret and process data within the controller. The controller 600 may include one or more displays or outputs (e.g., one or more LEDs, LCDs, speakers, haptic motors) 630, a plurality of inputs 640, and a communication link or communication adaptor 650 (preferably wireless) to the wheelchair lift 100, 200, 300, 400. In some embodiments, the controller 600 may be equipped with additional sensors 660.

The controller 600 requires a power source 610, which is preferably a battery. The controller battery may be smaller in both voltage and capacity than the battery used to power the wheelchair lift, but may include any of the technologies or chemistries described relating to the wheelchair lift battery 62/510. Preferably both batteries will be Lithium-Ion or Lithium-Polymer rechargeable batteries. The battery will provide power to the micro-controller or micro-computer 620, the LED or LCD output 630, the inputs 640, and the wireless connection 650 to the wheelchair lift 100, 200, 300, 400. In a preferred embodiment, the controller 600 may be mounted somewhere on the wheelchair lift 100, 200, 300, 400, and the controller battery 610 may recharge either from the wheel chair lift battery 62/510 or from an external power source while the wheelchair lift is itself recharging. Although the wheelchair lift battery 62/510 may be a powerful 24V battery to enable all of the raising and lowering, the controller battery 610 may only require 3.3 v, 3.7 v, or 5 v output.

In some embodiments, such as the embodiment shown in FIG. 23, the micro-computer 620 of the controller 600 may include a processor 621, a transitory memory 622, and a non-transitory memory or storage 623. The controller MCU 620 may function similarly to the MCU of the wheelchair lift; however, unlike the wheelchair lift, the controller MCU is unlikely to require motor controllers. In some instances, the controller and/or the wheelchair lift 100, 200, 300, 400 may exhibit machine learning, recognizing patterns of repeated behavior to automatically recognize sleep/battery preservation times like through the night and over the lunch hours.

The controller's LED or LCD output 630 that can display power level, weight measurements or calculations, any errors or error codes, or may display generic (e.g., time, date, weather, news) or wheelchair occupant specific information (e.g., name, age, destination, doctors, or treatments).

The controller 600 includes a plurality of inputs 640 which preferably include at least raise, lower, faster, slower, and mode commands. These inputs may take the form of traditional buttons, switches, joysticks, or other known electronic inputs. In other embodiments, the inputs may be through a touchscreen or voice command (such as OK Google, Siri, Cortana or Alexa).

The communications path 650 may be a wired connection or alternatively may communicate through Bluetooth, Bluetooth Low Energy (BLE), 802.11 (WiFi), infrared, cellular data, or any other known wireless communication technology. In some embodiments the controller 600 may be hand-held by the wheelchair occupant or by a person assisting to transport the wheelchair occupant. In other aspects the controller 600 may be mountable on the wheelchair or on a body-mounted control.

In some aspects, the wheelchair lift may be paired with and operated by a smartphone, a wearable computer, voice control, or a smart home base station (possibly through either an app or recipe). The application software can be configured to allow the user to assign a location, home, etc., to the controller 600 or wheel chair lift 100, 200, 300, 400. In addition, the application software can be configured to allow the user to assign pre-set heights to different rooms within a home, office, or care facility.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A wheel chair lifting device comprising:

a stationary platform, which is roughly rectangular and has four corners;

a movable lift assembly;

four motorized scissor jacks connecting the stationary platform to the movable lift assembly and configured to lift said movable lift assembly relative to said stationary platform;

one said motorized scissor jack is connected near each of the four corners of the stationary platform;

said motorized scissor jacks form right lift jacks and left lift jacks;

a foot stand platform connected to the movable lift assembly;

a battery power supply configured to supply power to the motorized scissor jacks and a wireless receiver; and the wireless receiver powered by the battery power supply and configured to receive wireless signals from an external communication device to control the height of the motorized scissor jacks;

said movable lift assembly includes a forward panel, a rear panel, a pair of rigid members connecting said forward panel to said rear panel, and four Z-shaped brackets connecting said forward and rear panels to a top surface of each of the four said motorized scissor jacks;

said foot stand platform is hinged to allow access of said battery and said wireless receiver stored under said foot stand platform;

said movable lift assembly is formed by two halves connected by a central hinge;

said right lift jacks are aligned and powered by a single right motor and single right lead screw;

said left lift jacks are aligned and powered by a single left motor and single left lead screw;

a weighing device and a digital readout configured to display a weight determined by the weighing device; and the wheel chair lifting device is configured to be foldable along the central hinge for more compact storage and transport.

2. The wheel chair lifting device of claim 1 wherein the wheel chair lifting device comprises exactly four motorized scissor jacks.

3. The wheel chair lifting device of claim 2 wherein the stationary platform is roughly rectangular and a motorized scissor jack is connected near each of the four corners of the stationary platform.

4. The wheel chair lifting device of claim 3 wherein the movable lift assembly is roughly rectangular and a motorized scissor jack is connected near each of the four corners of the stationary platform.

5. The wheel chair lifting device of claim 4 further comprising a carry handle.

6. The wheel chair lifting device of 4 further comprising a plurality of casters mounted to a perpendicularly disposed panel attached to said stationary platform.

7. The wheel chair lifting device of claim 4 wherein said wireless controller is a hand-held device.

8. The wheel chair lifting device of claim 4 wherein each said scissor jacks is covered by a hollow housing mounted to each said scissor jack.

9. The wheel chair lifting device of claim 4 wherein the foot stand platform is attached.

10. The wheel chair lifting device of claim 9 wherein said battery power supply and said wireless receiver are each mounted to said stationary platform and positioned beneath said foot stand platform.

11. A wheel chair lifting device comprising:

a roughly rectangular stationary platform including four platform corners;

a front-right motorized scissor jacks connected to the top of the front-right platform corner of the stationary platform;

a front-left motorized scissor jacks connected to the top of the front-left platform corner of the stationary platform;

a rear-right motorized scissor jacks connected to the top of the rear-right platform corner of the stationary platform;

a rear-left motorized scissor jacks connected to the top of the rear-left platform corner of the stationary platform;

a roughly rectangular movable lift assembly including four assembly corners, the movable lift assembly comprising:

a forward panel;

a rear panel;

a left rigid member connecting the left side of said forward panel to the left side of said rear panel;

a right rigid member connecting the right side of said forward panel to the right side of said rear panel;

a front-right Z-shaped bracket connecting the front-right corner of the lift assembly to the top surface of the front-right scissor jacks;

a front-left Z-shaped bracket connecting the front-left corner of the lift assembly to the top surface of the front-left scissor jacks;

a rear-left Z-shaped bracket connecting the rear-left corner of the lift assembly to the top surface of the rear-left scissor jacks; and a rear-right Z-shaped bracket connecting the rear-right corner of the lift assembly to the top surface of the rear-right scissor jacks;

a foot stand platform attached to the forward end of said left rigid member and said right rigid member of the movable lift assembly; and a plurality of casters mounted to a perpendicularly disposed panel attached to said stationary platform;

wherein the four motorized scissor jacks are configured to lift said movable lift assembly relative to said stationary platform.

12. The wheel chair lifting device of claim 11 further comprising:

a left motor configured to drive a left lead screw, the left lead screw driving both the front-left motorized scissor jack and the rear-left motorized scissor jack;

a right motor configured to drive a right lead screw, the right lead screw driving both the front-right motorized scissor jack and the rear-right motorized scissor jack; and a battery power supply configured to supply power to the motors.

13. The wheel chair lifting device of claim 12 further comprising a wireless receiver powered by the battery power supply and electrically connected to both the left motor and the right motor, the wireless receiver being configured to receive wireless signals from an external communication device to control the motors.

* * * * *